US005231774A

United States Patent [19]

Kose et al.

[11] Patent Number: 5,231,774

[45] Date of Patent: Aug. 3, 1993

[54] PHOTOSENSITIVE MATERIAL DRYING APPARATUS

[75] Inventors: Junichi Kose; Shinichi Matsuda; Motoharu Komori, all of Kanagawa, Japan

[73] Assignee: Fuji Photo Film Co., Ltd., Kanagawa, Japan

[21] Appl. No.: 804,417

[22] Filed: Dec. 10, 1991

[30] Foreign Application Priority Data

Dec. 10, 1990 [JP] Japan ..... 2-401170
Dec. 10, 1990 [JP] Japan ..... 2-401171
Jan. 18, 1991 [JP] Japan ..... 3-4674

[51] Int. Cl.[5] ..... F26B 13/00

[52] U.S. Cl. ..... 34/160; 34/162; 34/155

[58] Field of Search ..... 34/155, 162, 18, 150, 34/151, 152, 160, 23

[56] References Cited

U.S. PATENT DOCUMENTS

| | | | |
|---|---|---|---|
| 3,208,158 | 9/1965 | Smith, Jr. | 34/114 |
| 3,375,593 | 4/1968 | Fleisher et al. | 34/162 |
| 3,434,225 | 3/1969 | Knibiehly | 34/162 |
| 3,834,040 | 9/1974 | Russell et al. | 34/155 |
| 4,125,948 | 11/1978 | Hering, Jr. et al. | 34/160 |
| 4,142,301 | 3/1979 | Goodall | 34/162 |
| 4,693,014 | 9/1987 | Caflisch et al. | 34/155 |
| 5,079,853 | 1/1992 | Kurokawa | 34/114 |
| 5,097,605 | 3/1992 | Kashino et al. | 34/18 |

FOREIGN PATENT DOCUMENTS 1-123236 5/1989 Japan .

*Primary Examiner*—Henry A. Bennett
*Assistant Examiner*—Denise L. Gromada
*Attorney, Agent, or Firm*—Sughrue, Mion, Zinn, Macpeak & Seas

[57] ABSTRACT

A photosensitive material drying apparatus includes rollers forming a film transport passage and warm-air supplying chambers respectively disposed in the vicinity of the rollers. A pair of warm-air discharging portions is formed in each warm-air supplying chamber in such a manner as to straddle the roller and project toward the film transport passage. Each warm-air discharging portion blows warm air onto a film portion in proximity to and upstream of a roller-contacting portion of the film or a film portion in proximity to and downstream of another roller-contacting portion of the film. An exhaust hole for exhausting the warm air blown onto the film away from the transport passage side is formed in the warm-air supplying chamber between extensions of the warm-air discharging portions. A warm-air exhaust portion for exhausting the warm air blown onto the film is formed between adjacent ones of the warm-air supplying chambers as well. Accordingly, the warm air blown onto the film can be exhausted efficiently from the vicinity of the photosensitive material.

22 Claims, 18 Drawing Sheets

PHOTOSENSITIVE MATERIAL DRYING APPARATUS

BACKGROUND OF THE INVENTION

1. Field of the Invention

The present invention relates to a photosensitive material drying apparatus and, more particularly, to a photosensitive material drying apparatus for drying a photosensitive material by blowing warm air onto it.

2. Description of the Related Art

A conventionally known photosensitive material drying apparatus for drying a photosensitive material such as photographic film by blowing warm air onto the same is arranged as follows. A vertically extending transport passage for a film is formed by a plurality of rollers in a photosensitive material drying apparatus, and the plurality of rollers are arranged at equal intervals in a zigzag manner. The film which has been developed by wet process and which is in a wet condition is introduced into the drying apparatus, and transported while being guided by the rollers along the transport passage therein. A plurality of warm-air supplying chambers are disposed in the vicinity of the rollers in two rows with the film transport passage placed therebetween. Warm air produced by a fan and a heater is supplied to the warm-air supplying chambers. Each warm-air supplying chamber is provided with two warm-air discharge ports along the traveling direction of the film. The warm air supplied to each warm-air supplying chamber is discharged through the warm-air discharge ports onto the film portions each located in the vicinity and upstream, as viewed in the traveling direction of the film, of a respective roller-contacting portion of the film. The film is thus dried.

To reduce the drying time in the apparatus for drying film by blowing warm air onto it, the amount of warm air blown onto the film is usually increased since increasing the temperature of the warm air can disadvantageously cause the film to curl. With respect to the above-described conventional photosensitive material drying apparatus, however, if the distance between the warm-air discharge port and the film is reduced to increase the amount of warm air blown and the warm air is blown onto the film perpendicularly thereto, the drying efficiency with respect to each film portion located in proximity to the roller-contacting portion of the film becomes aggravated, resulting in unevenness in drying.

To overcome this problem, a photosensitive material drying apparatus has been proposed in which, as shown in FIG. 17, warm air is discharged diagonally toward film portions each located in proximity to the respective roller-contacting portion of a film 774 through pairs of warm-air discharge ports 778 respectively provided on the upstream and downstream sides with a respective roller 772 placed therebetween along the film transport passage (Japanese Patent Application Laid-Open No. 1-123236).

With this photosensitive material drying apparatus, as warm air is discharged diagonally toward each film portion located in proximity to and upstream of the respective roller-contacting portion of the film 774 (in the direction of arrow E in FIG. 17) and toward each film portion located in proximity to and downstream of that roller-contacting portion of the film 774 (in the direction of arrow F in FIG. 17), water remaining in proximity to each roller-contacting portion of the film 774 is caused to evaporate so as to eliminate unevenness in the drying of the film 774. In addition, the warm air discharged through the warm-air discharge ports 778, after evaporating the water on the film 774 and becoming highly humid, is allowed to escape in a direction away from the film 774 through exhaust holes 779 each formed in a respective warm-air supplying chamber 776 in such a manner as to extend transversely therethrough between extensions of the pair of warm-air discharge ports 778.

However, with the conventional photosensitive material drying apparatus mentioned first and the photosensitive material drying apparatus disclosed in the aforementioned Japanese Patent Application Laid-Open No. 1-123236, the warm air is discharged toward the film through the pairs of warm-air discharge ports provided in the warm-air supplying chambers, and the warm air thus discharged is mainly exhausted between the respective pairs of warm-air discharge ports through the exhaust holes formed in the respective warm-air supplying chambers. Hence, there are cases where the exhausting of air after drying lags behind, with the result that the highly humid air remains in the vicinity of the film. For this reason, there has been a drawback in that the efficiency with which the film is dried is deteriorated.

In addition, in a case where variations occur in the traveling speed of the film owing to contact between each roller and the tip of the film being transported by the rollers, the following problem can occur. With the photosensitive material drying apparatus in which warm air is constantly blown onto film portions each located in the vicinity and upstream of the roller-contacting portion of the film, since the warm-air discharge ports are arranged at equal intervals, the warm air fails to be blown evenly with respect to the traveling direction. Hence, there occur in the film those portions onto which a greater amount of warm air is blown as compared with the remaining portions, resulting in unevenness in the drying of the film.

SUMMARY OF THE INVENTION

In view of the above-described circumstances, it is an object of the present invention to provide a photosensitive material drying apparatus with excellent drying efficiency which is capable of efficiently discharging warm air blown onto a photosensitive material and rendered highly humid from the vicinity of the surface of a photosensitive material such as film without causing unevenness in the drying of the photosensitive material even if variations occur in the traveling speed of the photosensitive material.

To this end, in accordance with a first aspect of the invention, there is provided a photosensitive material drying apparatus for drying a photosensitive material by blowing drying air onto a surface of the photosensitive material moving along a photosensitive material transport passage formed by arranging a plurality of rollers, comprising: a plurality of drying-air supplying chambers disposed along the photosensitive material transport passage; a pair of drying-air discharge ports provided in such a manner as to communicate with a respective one of the drying-air supplying chambers in correspondence with a respective one of the plurality of rollers and adapted to blow the drying air onto a film portion located in proximity to a roller-contacting portion of the film, the drying-air discharge ports being offset from each other in such a manner as to be oriented away from each other; a through hole provided through a respective one of the drying-air supplying chambers in such a manner as to extend from a photosensitive material transport passage side thereof to an opposite side thereof, an end of the through hole on the photosensitive material transport side thereof being disposed between the pair of drying-air discharge ports, the through hole being used to exhaust the drying air after being blown onto the photosensitive material; and an exhaust passage provided between adjacent ones of the plurality of drying-air supplying chambers and serving together with the through hole a drying-air exhaust portion.

With the photosensitive material drying apparatus arranged as described above, the pair of drying-air discharge ports provided in each drying-air supplying chamber serve as a drying-air discharge port for discharging drying air onto a film portion located in the vicinity of and downstream, as viewed in the traveling direction of the photosensitive material, of a roller-contacting portion of the photosensitive material and as a drying-air discharge port for discharging drying air onto a film portion located in the vicinity of and downstream of another roller-contacting portion of the photosensitive material.

Accordingly, intervals at which the warm air is blown onto the photosensitive material surface along the traveling direction of the photosensitive material differ. The drying air blown onto the photosensitive material being transported by the rollers, after drying the photosensitive material, is exhausted through the through holes respectively formed in the drying-air supplying chambers, and is also exhausted through exhaust passages respectively formed between adjacent ones of the drying-air supplying chambers. This exhaust passage can be formed to be wider than the through hole formed in the drying-air supplying chamber. Thus, the drying air blown onto the photosensitive material can be exhausted efficiently from the vicinity of the photosensitive material surface through the through holes formed in the respective drying-air supplying chambers and through the exhaust passages each formed between adjacent ones of the drying-air supplying chambers. In addition, the drying air newly discharged through the drying-air discharge ports is capable of reliably drying the photosensitive material surface.

In accordance with a second aspect of the invention, there is provided a photosensitive material drying apparatus for drying a photosensitive material by blowing drying air onto a surface of the photosensitive material moving along a photosensitive material transport passage formed by arranging a plurality of rollers, comprising: a plurality of drying-air supplying chambers disposed along the photosensitive material transport passage; a first pair of substantially parallel drying-air discharge ports disposed in such a manner as to communicate with a respective one of the drying-air supplying chambers in correspondence with a respective one of the plurality of rollers and adapted to blow the drying air onto a film portion located in proximity to a roller-contacting portion of the film, the first pair of drying-air discharge ports being oriented in a traveling direction of the photosensitive material; a second pair of substantially parallel drying-air discharge ports disposed adjacent to the first pair of drying-air discharge ports and oriented in a direction opposite to the traveling direction of the photosensitive material; a through hole provided through a respective one of the drying-air supplying chambers in such a manner as to extend from a photosensitive material transport passage side thereof to an opposite side thereof, an end of the through hole on the photosensitive material transport side thereof being disposed between the pair of drying-air discharge ports, the through hole being used to exhaust the drying air after being blown onto the photosensitive material; and an exhaust passage provided between adjacent ones of the plurality of drying-air supplying chambers and serving together with the through hole a drying-air exhaust portion.

With the photosensitive material drying apparatus in accordance with this aspect of the invention, the pair of drying-air discharge ports disposed in the drying-air supplying chamber discharges drying air substantially parallel with each other. Furthermore, drying-air supplying chambers each adapted to blow drying air through a pair of substantially parallel drying-air discharge ports onto two film portions in the vicinity to and upstream of respective two roller-contacting portions of the photosensitive material and adjacent drying-air supplying chambers each adapted to blow drying air through a pair of substantially parallel drying-air discharge ports onto two film portions in the vicinity to and downstream of respective two roller-contacting portions of the photosensitive material are arranged alternately along the transport passage. As a result, intervals at which the drying air is blown onto the photosensitive material surface are formed along the traveling direction of the photosensitive material. Furthermore, the drying air discharged through a respective one of the pair of the drying-air discharge ports disposed in these drying-air supplying chambers is mainly exhausted through the through hole formed in the respective drying-air supplying chambers, while the drying air discharged through the other ones of the pair of drying-air discharge ports can be exhausted through exhaust passages formed between adjacent ones of the drying-air supplying chambers.

These photosensitive material drying apparatuses make it possible to efficiently exhaust the air after the drying of the photosensitive material. In addition, even when variations occur in the traveling speed of the photosensitive material each time the tip of the photosensitive material being transported by the rollers abuts against the respective roller, cases in which drying air is blown onto fixed portions of the photosensitive material can be reduced in number, thereby making it possible to dry the photosensitive material substantially uniformly.

The photosensitive material drying apparatus in accordance with a third aspect of the invention, there is provided a photosensitive material drying apparatus for drying a photosensitive material by blowing drying air onto a surface of the photosensitive material being transported along a photosensitive material transport passage, comprising: a drying-air supplying chamber having an opening portion into which drying air from a drying-air producing portion flows; a drying-air discharge port formed in a configuration of a slit which is elongated in the direction parallel with the transverse direction of the photosensitive material transport passage, the drying-air discharge port being adapted to allow the drying air flowing into the drying-air supplying chamber to be discharged onto the photosensitive material; a direction-converting portion for converting the direction of the drying air flowing in through the opening portion to a direction of the drying-air discharge port; and drying-air adjusting means for rendering the drying air discharged through the drying-air discharge port substantially uniform along the transverse direction of the photosensitive material transport passage.

With the above-described photosensitive material drying apparatus in accordance with the third aspect of the invention, the drying-air supplying chamber receives drying air produced by the drying-air producing portion through an opening portion, the direction of the drying air received is converted to the direction of the drying-air discharge port formed substantially in a slit by the direction-converting portion, and the drying air whose direction of flow has been converted is discharged through the drying-air discharge port onto the photosensitive material over the entire transverse length thereof.

As one form of the drying-air adjusting means, the drying-air adjusting means may comprise: a first wall surface disposed on the photosensitive material side of the opening portion; a second wall surface disposed in such a manner as to extend from the first wall surface toward the photosensitive material; and an angle portion jointing together the first wall surface and the second wall surface, wherein an end of the second wall surface on the photosensitive material side may be located outside a line connecting the corner of the angle portion and an end of the photosensitive material close to the second wall.

In this form, the drying-air adjusting means is constituted by the first wall surface disposed in the opening portion and the second wall surface jointed to the first wall surface by means of the angle portion. This angle portion is disposed in such a manner as to form a swirl of drying air discharged through the vicinity of the second wall surface. As a result, it is possible to reduce the amount of drying air discharged through the vicinity of the second wall surface, thereby allowing the amount of drying air discharged through the drying-air discharge port to become substantially uniform along the transverse direction of the photosensitive material.

As another form of the drying-air adjusting means, the drying-air adjusting means may comprise: a first wall surface disposed on the photosensitive material side of the opening; a second wall surface disposed with one end abutting the first wall surface and another end oriented toward the photosensitive material; and a baffle plate disposed in such a manner as to project from the first wall surface along the drying-air discharge port.

According to the drying-air adjusting means in this form, the amount of drying air flowing to the vicinity of the second wall surface is reduced by the baffle plate, causing a swirl to be produced in the vicinity of the second wall surface. For this reason, the amount of drying air discharged through the vicinity of the second wall surface is reduced. Accordingly, the drying air discharged through the drying-air discharge port toward the photosensitive material is discharged substantially uniformly along the transverse direction of the photosensitive material.

In still another form of the drying-air adjusting means, the drying-air adjusting means may be arranged such that a gap of the drying-air discharge port along a traveling direction of the photosensitive material is reduced gradually from a longitudinally intermediate portion of the drying-air discharge port toward an end portion of the drying-air discharge port on an opening portion side, and a portion of the drying-air discharge port on the opening portion side is closed.

According to this form, a portion of the drying-air discharge port on the opening portion side to which drying air is supplied in large volumes is narrowed. A swirl of drying air occurs on the upstream side, as viewed in the drying-air discharging direction, of the drying-air discharge port when the drying-air discharge port is made gradually narrow toward the angle portion on the opening portion side, so as to reduce the amount of drying air discharged in that portion. As a result, the drying air discharged through the drying-air discharge port is discharged substantially uniformly along the transverse direction of the photosensitive material.

In addition, in a further form of the drying-air adjusting means, the drying-air adjusting means may be constituted by a baffle plate disposed in such a manner as to close part of the opening portion and forming a space wherein the flow of drying air supplied from the drying-air producing portion is prevented.

According to this form, the drying air produced by the drying-air producing portion is supplied through the opening portion, but a baffle plate is provided in this opening portion. As a result, the drying air supplied through the opening causes a swirl to be formed downstream of the baffle plate, and causes the velocity of the warm air passing the vicinity of the baffle plate to decline. Hence, the velocity of the drying air supplied through the opening does not become uniform, and the velocity of the air on the photosensitive material side of the opening portion becomes higher, and as the direction of the air flow is converted to the discharging direction at the direction-converting portion, the drying air is discharged substantially uniformly along the transverse direction of the photosensitive material.

With the photosensitive material drying apparatus in accordance with the third aspect of the invention, it is possible to allow the drying air to be blown substantially uniformly onto the photosensitive material surface without being discharged in extremely large volumes from one end of the drying-air discharge port. By means of this drying air, the photosensitive material is dried. Since a portion of the drying-air discharge port where the amount of drying air becomes extremely large is eliminated, it is possible to allow the warm air produced by the drying-air producing portion to be blown efficiently onto the photosensitive material and dry the photosensitive material without causing an excessively dried portion to be produced at a transverse end of the photosensitive material.

The present invention is capable of providing a photosensitive material drying apparatus combining the above-described first and second aspects. In accordance with the photosensitive material drying apparatus having this combined structure, it is possible to effect uniform drying both in the traveling direction of the photosensitive material and in the transverse direction thereof.

It should be noted that war air, or air or the like dried by being allowed to pass through a drying agent such as silica gel, may be used as drying air.

DESCRIPTION OF THE PREFERRED EMBODIMENTS

Referring now to the accompanying drawings, a detailed description will be given of a first embodiment of the present invention. In this embodiment, a description will be given of an example in which a photosensitive material drying apparatus in accordance with the present invention is applied to an automatic processor 10 which is a photographic film processing machine.

Figure 2:
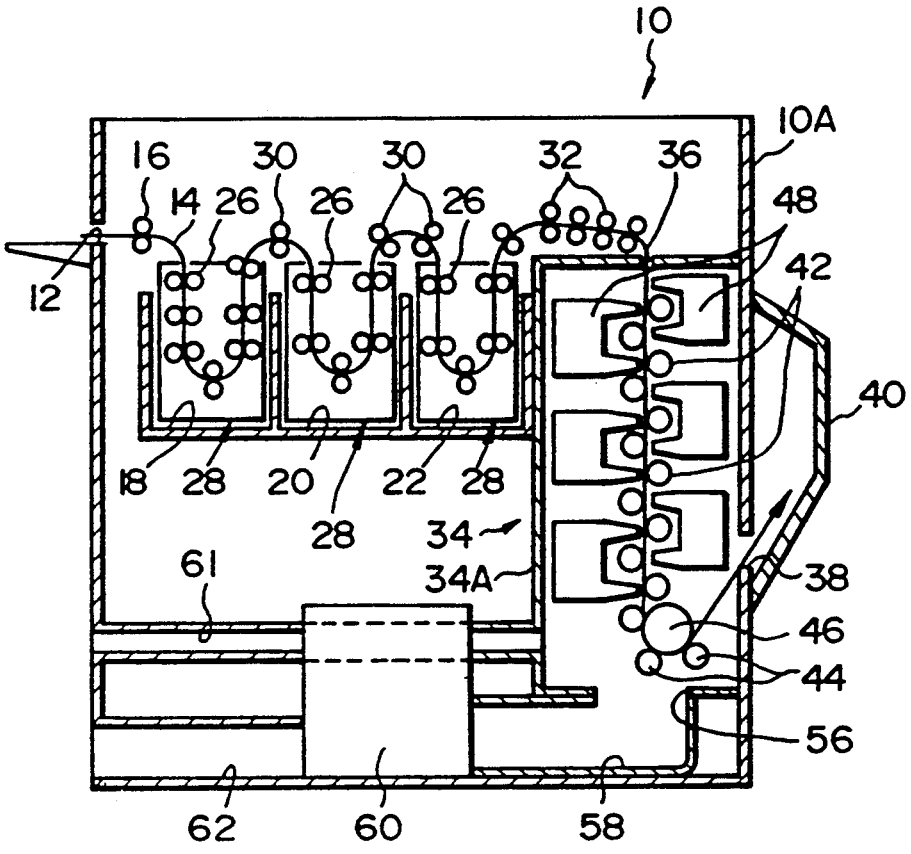
FIG. 2 is a schematic cross sectional view of an automatic processor to which the photosensitive material drying apparatus in accordance with the first embodiment is applied.

FIG. 2 schematically illustrates the automatic processor 10. A film 14 (e.g., a photosensitive material such as an X-ray film or a photographic film) transported to the interior of a machine body 10A of the automatic processor 10 through a insertion port 12 is adapted to be introduced to a drying section 34 via a developing tank 18, a fixing tank 20, and a washing tank 22 by being guided by guide rollers 16. A rack 28 constituted by a plurality of guide rollers 26 is accommodated in each of the developing tank 18, the fixing tank 20, and the washing tank 22. By means of these racks 18 the film 14 is passed through the liquid surface to the bottom of one tank and then inverted and guided to the liquid surface of another tank so as to be immersed into the respective tanks.

Guide rollers are disposed between the developing tank 18 and the fixing tank 20 and between the fixing tank 20 and the washing tank, respectively, so that the film 14, while being consecutively guided to the adjoining tanks, is subjected to the respective steps of processing including development, fixing, and washing. In addition, a plurality of pairs of rollers 32 are disposed between the washing tank 22 and the drying section 34, and the film subjected to washing is guided to a drying section body 34A of the drying section 34. Part of the water adhering to the film 14 is squeezed off by the pairs of rollers 32.

Figure 3:
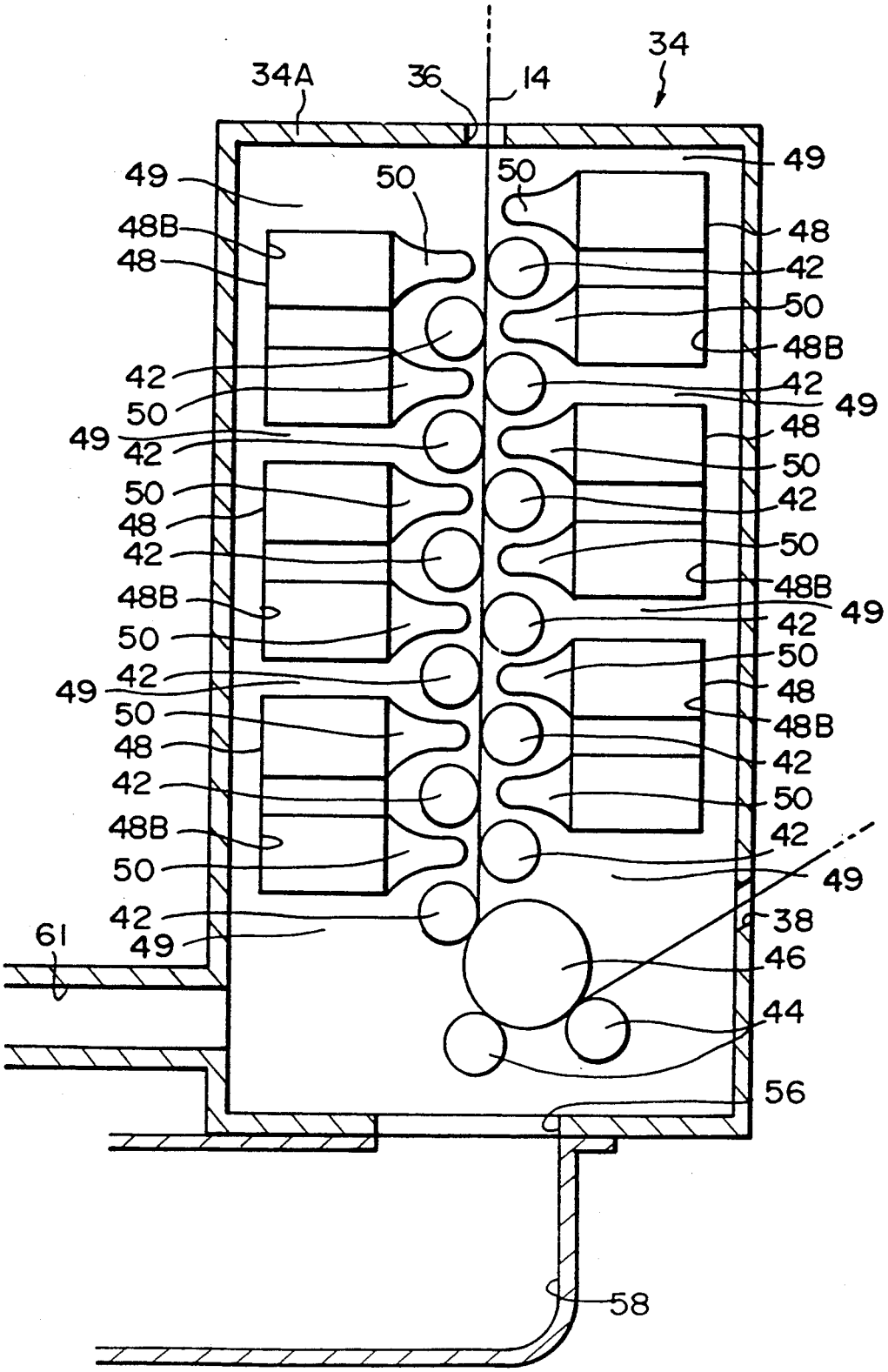
FIG. 3 is a cross-sectional view of a drying section in accordance with the first embodiment.

As shown in FIG. 3, a plurality of rollers 42 supported rotatably by the drying section body 34A are arranged in a zigzag manner inside the drying section body 34A, and a transport passage for the film 14 is formed by these rollers 42. The rollers 42 are disposed at equal intervals along the transport passage. These rollers 42 rotate as a driving force of an unillustrated driving means is imparted thereto, so as to transport the film 14 sent to the interior of the drying section body 34A in a downstream direction (downwardly in FIG. 3) along the transport passage.

Two guide rollers 44 having the same diameter as that of the roller 42 and a guide roller 46 having a larger diameter than that of the roller 42 are disposed in a lower portion of the drying section body 34A. The rollers 44 and 46 are rotatably supported by the drying section body 34A, and the driving force of the unillustrated driving means is transmitted thereto. The film 14 guided to the lower portion of the drying section body 34A is inverted by these rollers 44 and 46, and is discharged through a discharge port 38 to a film-receiving box 40 attached to the outside of the machine body 10A (see FIG. 2).

Warm-air supplying chambers 48 are disposed in two rows with the film transport passage placed therebetween in the vicinity of the rollers 42 inside the drying section body 34A. The longitudinal direction (the direction of double. headed arrow L in FIG. 5) of each warm-air supplying chamber 48 is parallel with the transverse direction of the film 14, and the longitudinal dimension of the warm-air supplying chamber 48 is set to be greater than the widthwise dimension of the film 14. As shown in FIG. 5, each warm-air supplying chamber 48 is provided with an opening 48B at one longitudinal end of a proximal portion 48A, and warm air produced by a fan 60 (see FIG. 4) and a heater which will be described later is supplied through this opening 48B. A pair of warm-air discharging portions 50 extending along the longitudinal direction of the proximal portion 48A are provided on the proximal portion 48A of the warm-air supplying chamber 48.

Figure 1:
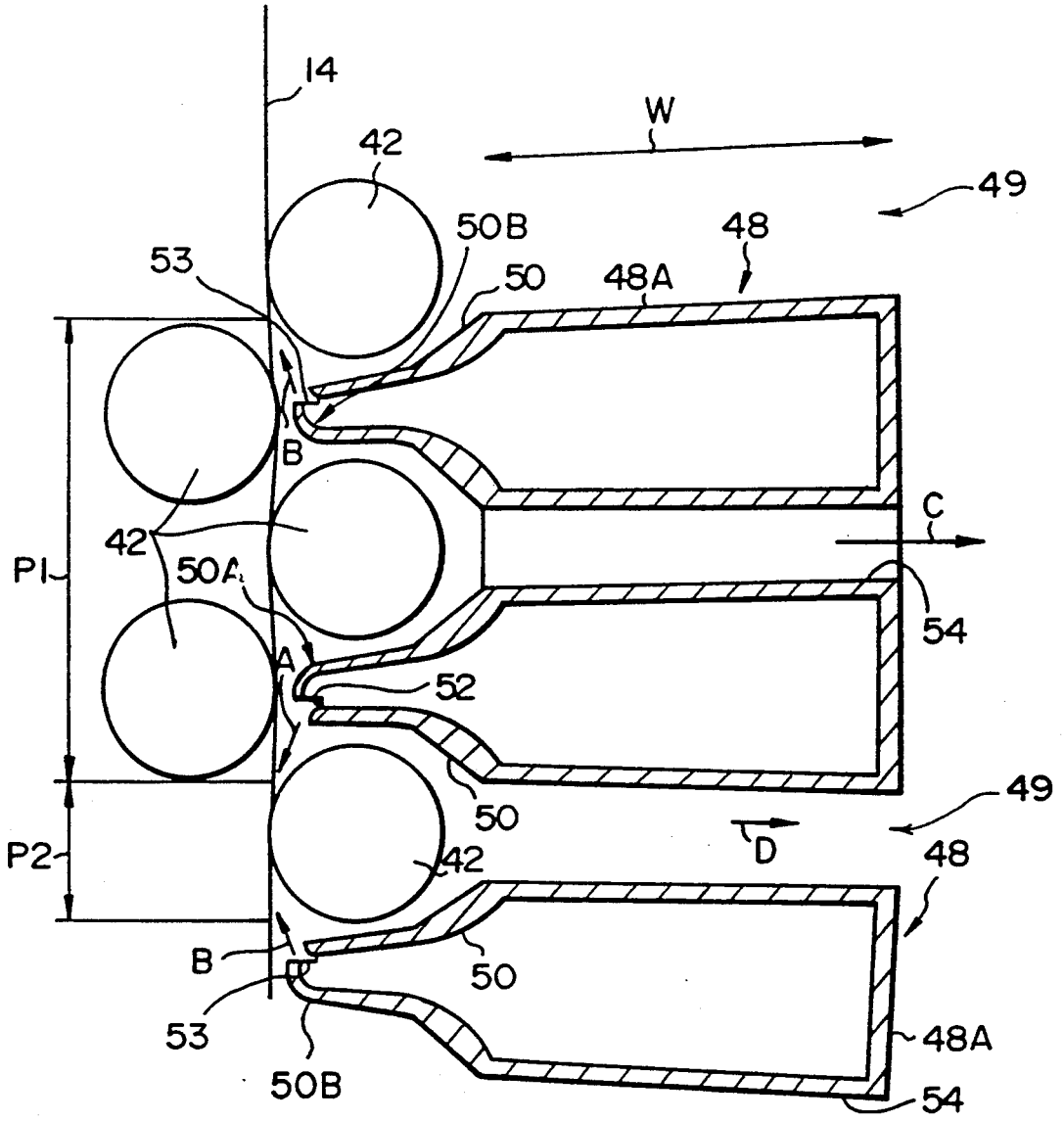
FIG. 1 is a cross-sectional view of essential portions of a photosensitive material drying apparatus in accordance with a first embodiment of the present invention.

Each of these warm-air discharging portions 50 has a hollow interior and communicates with the proximal portion 48A. As shown in FIG. 1, warm-air discharge ports 52 and 53 are each provided in such a manner as to be offset toward one thicknesswise (vertical in FIG.

1) end of the warm-air discharging portion 50, and the respective thicknesswise other ends thereof are formed in an arcuate form as arcuate portions 50A and 50B. That is, in the upstream side warm-air discharging portion 50 as viewed in the advancing direction of the film 14, the warm-air discharge port 53 is formed on the upstream side, while the arcuate portion 50B is formed on the downstream side. In the downstream-side warm-air discharging portion 50, the warm-air discharge port 52 is formed on the downstream side, while the arcuate portion 50A is formed on the upstream side. As a result, the warm air supplied to the interior of the warm-air supplying chamber 48 is guided to the distal ends of the warm-air discharging portions 50, and is discharged diagonally in the upstream direction (in the direction of arrow B in FIG. 1) and in the downstream direction (in the direction of arrow A) along the film transport passage by means of the offset warm-air discharge ports 52 and 53 and arcuate portions 50A and 50B.

In addition, as shown in FIG. 5, the widthwise dimension of the proximal portion 48A (the dimension in the direction of double-headed arrow W in FIG. 5) is made gradually smaller from one end where the opening 48B is provided toward the other end thereof. As a result, the amount of warm air discharged through the warm-air discharge ports 52 and 53 is made substantially uniform over a range extending from one longitudinal end to the other end of each warm-air discharging portion 50.

As shown in FIG. 1, an interval between the centers of film portions onto which the warm air discharged through the warm-air discharge ports 52 and 53 of the warm-air supplying chamber 48 disposed on one side of the film 14 is blown is set to be a dimension Pl. Meanwhile, an interval between the centers of film portions onto which the warm air is blown through the warm-air discharge port 52 of the warm-air supplying chamber 48 on the upstream side of the film transport passage and through the warm-air discharge port 53 of the downstream-side warm-air supplying chamber 48 is set to be a dimension P2. As for these intervals P1 and P2, the interval P1 is set to be greater than the dimension P2. As a result, the interval in which the warm air is blown onto the film 14 differs for the respective rollers.

As shown in FIGS. 1 and 5, an exhaust hole 54 is formed in each proximal portion 48A in such a manner as to extend transversely therethrough between extensions of the pair of warm-air discharging portions 50. This exhaust hole 54 is elongated in the longitudinal direction of the proximal portion 48A, and its opening is formed in an elliptical configuration. As shown in FIG. 1, part of the warm air discharged through the warm-air discharge ports 52 and 53 onto the film 14 is exhausted in a direction away from the film transport passage (in the direction of arrow C in FIG. 1) via the exhaust hole 54. Furthermore, the adjacent ones of the warm-air supplying chambers 48 are spaced apart from each other to provide an open space serving as an exhaust passage 49 from the film transport passage to the side of the warm-air supplying chamber 48 away from the film transport passage. The opening of this exhaust passage 49 as viewed from the film 14 side extends between the opposite sides of the drying section body 34A along the longitudinal direction of the warm-air supplying chamber 48. After the film 14 is dried by the warm air blown onto the film 14, the warm air can be exhausted in a direction away from the film transport passage (in the direction of arrow D in FIG. 1).

Meanwhile, as shown in FIGS. 2 and 3, an exhaust port 56 is provided in a bottom of the drying section body 34A, and one end of a return duct 58 is attached in correspondence with the exhaust port 56 in the drying section body 34A. The other end of the return duct 58 is connected to the intake side of the fan 60. An intake duct 62 communicating with the machine body 10A is connected to an intermediate portion of the return duct 58.

The drying section body 34A is provided with an exhaust duct 61 for exhausting the highly humid air after the drying of the film 14 in the drying section body 34A. The warm air blown onto the film 14 via the warm-air discharge ports 52 and 53 is exhausted from the vicinity of the surface of the film 14, forms an air flow directed toward the lower portion of the drying section body 34A, and is exhausted through the exhaust duct 61 to outside the machine body 10A. Part of the air flow directed toward the lower portion of the drying section body 34A is guided to the intake side of the fan 60 together with the air outside the machine body 10A taken in through the intake duct 62 via the exhaust port 56 and the return duct 58.

As for the air guided to the intake side of the fan 60, the proportion of the air flowing in through the drying section body 34A is approximately 80% and the proportion of the air flowing in from outside the machine body 10A is approximately 20% through the ratio between the cross sectional area of the passage of the return duct 58 and the cross-sectional area of the passage of the intake duct 62.

Figure 4:
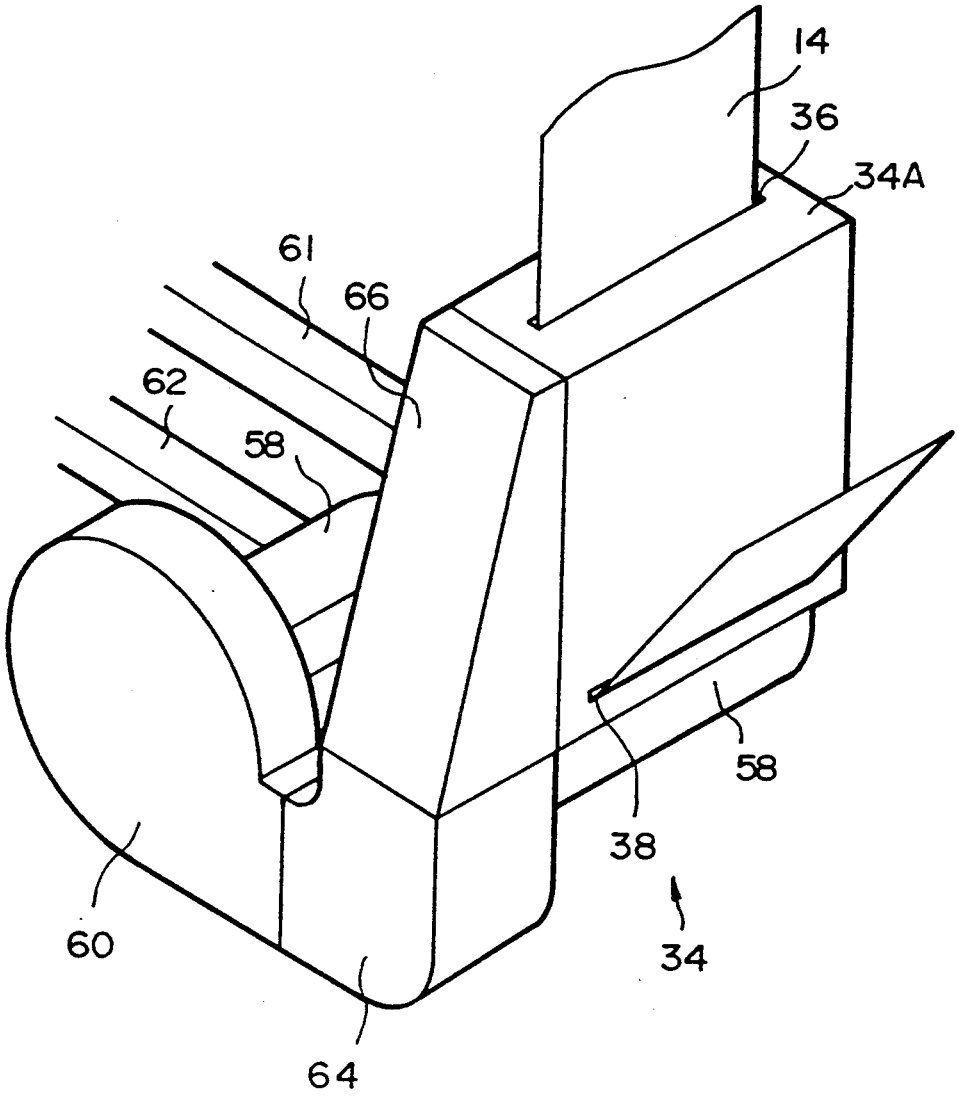
FIG. 4 is a perspective view of a body of the drying section in accordance with the first embodiment.
Figure 5:
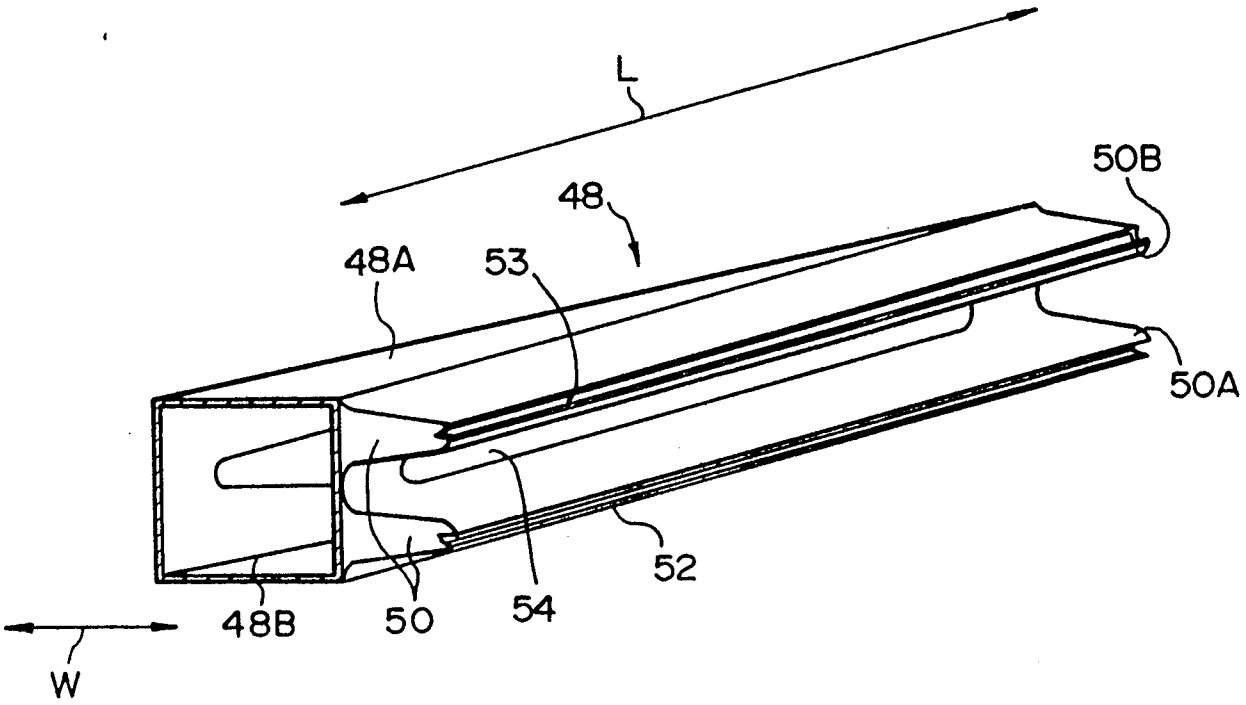
FIG. 5 is a perspective view of a warm-air supplying chamber in accordance with the first embodiment.

As shown in FIG. 4, one end of a heater box 64, in which an unillustrated heater is disposed, is fixed to the exhaust side of the fan 60. The heater box 64 is bent orthogonally at its central portion. The air guided to the intake side of the fan 60 is sent from the exhaust side as an air flow, is heated by the heater inside the heater box 64, and is sent out from the heater box 64 as warm air.

A duct 66 is fixed to the other end of the heater box 64. The side surface of the duct 66 is fixed to the side of the drying section body 34A along the traveling direction of the film 14, and unillustrated openings are provided in correspondence with the openings 48B in the respective warm-air supplying chambers 48 arranged as shown in FIG. 3. As a result, the duct 66 communicates with each warm-air supplying chamber 48, so that the warm air sent from the heater box 64 is supplied to each warm-air supplying chamber 48. In addition, as shown in FIG. 4, the cross-sectional area of the passage of the duct 66 is set to be gradually smaller toward the upstream side in the longitudinal direction of the duct 66, i.e., along the traveling direction of the film 14. Hence, the flow rate per unit time of the warm air branched off from the duct 66 and supplied to each warm-air supplying chamber 48 is rendered substantially uniform.

With the automatic processor 10 shown in FIG. 2, the film 14 imagewise exposed and inserted through the insertion port 12 is subjected to development, fixing, and washing, is then squeezed by the pairs of rollers 32, and is transported through a transport port 36 to the drying section body 34A of the drying section 34.

Inside the drying section body 34A, the film 14 is transported downwardly by the rollers 42, and the warm air discharged through the warm-air discharge ports 52 and 53 in the warm-air discharging portions 50 is blown onto the film 14 to dry the same. At this juncture, the warm air is discharged through the warm-air discharge ports 52 and 53 in the direction of arrow A in FIG. 1 by the offset warm-air discharge ports 52 and arcuate portions 50A and in the direction of arrow B in FIG. 1 by the offset warm-air blow ports 53 and arcuate portions 50B, so as to be blown onto the surface of the film 14 and dry the film 14.

The highly humid air after the drying of the film 14 is headed from the film surface to each open space formed between adjacent ones of the warm-air supplying chambers 48 and is exhausted through these spaces in a direction away from the film transport passage (indicated by arrow D in FIG. 1). Also, part of the highly humid air after the drying of the film 14 is exhausted through the exhaust holes 54 formed in the respective warm-air supplying chambers 48. Since the warm air is not discharged through the warm-air discharging portions 50 toward the roller 42 placed between the two warm-air discharging portions 50 in each warm-air supplying chamber 48, the amount of air exhausted through the exhaust holes 54 formed in the respective warm-air supplying chambers 48 is small.

As a result, the warm air discharged through the warm-air discharging portions 50, after drying the film 14, is exhausted in large volumes through each open space between the adjacent ones of the warm-air supplying chambers 48, while the amount of air exhausted through the exhaust holes 54 formed in the respective warm-air supplying chambers 48 is small. Hence, the highly humid air after the drying of the film 14 can be exhausted efficiently. In consequence, it becomes possible to constantly supply dry warm air to the surface of the film 14 through the warm-air discharge ports 52 and 53 in the warm-air discharging portions 50.

As for the film 14 transported by the rollers 42 in the drying section body 34A, there are cases there variations occur in the speed in which the film is transported by the rollers during the moments when the tip of the film 14 is brought into contact with each roller 42. These variations in speed occur each time when the film 14 moves by a predetermined amount (by the portion of the interval between the rollers 42) since the rollers 42 are disposed at equal intervals. In this embodiment, the intervals P1 and P2 (see FIG. 1) at which the warm air discharged through the warm-air discharge ports 52 and 53 in the respective warm-air supplying chambers 48 is blown onto the film 14 differ from each other. The rollers 42 are disposed at equal intervals, so that in cases where variations in speed occur in the traveling speed of the film 14, the same portions of the film 14 appear between the adjacent ones of the rollers 42. However, by virtue of the fact that the blowing intervals differ, it becomes possible to allow the warm air to be blown onto different portions of the film 14 on each such occasion.

That is, as shown in FIG. 3, when the time of the film 14 being transported by the rollers 42 is brought into contact with the roller 42, and when variations in speed occur in the traveling speed of the film 14, the same portions of the film 14 always appear between the adjacent ones of the rollers 42 on one side of the film 14, but the warm air is blown onto different portions of the same portions of the film 14 from the warm-air discharging portions 50 each time the variation in speed occurs. As a result, it is possible to eliminate unevenness in the drying of the film 14 and dry the film 14 substantially uniformly.

The film 14 which has been dried uniformly inside the drying section body 34A in the above-described manner is inverted by the guide rollers 44 and 46 and is then discharged through the discharge port 38 to the film-receiving box 40.

Figure 6:
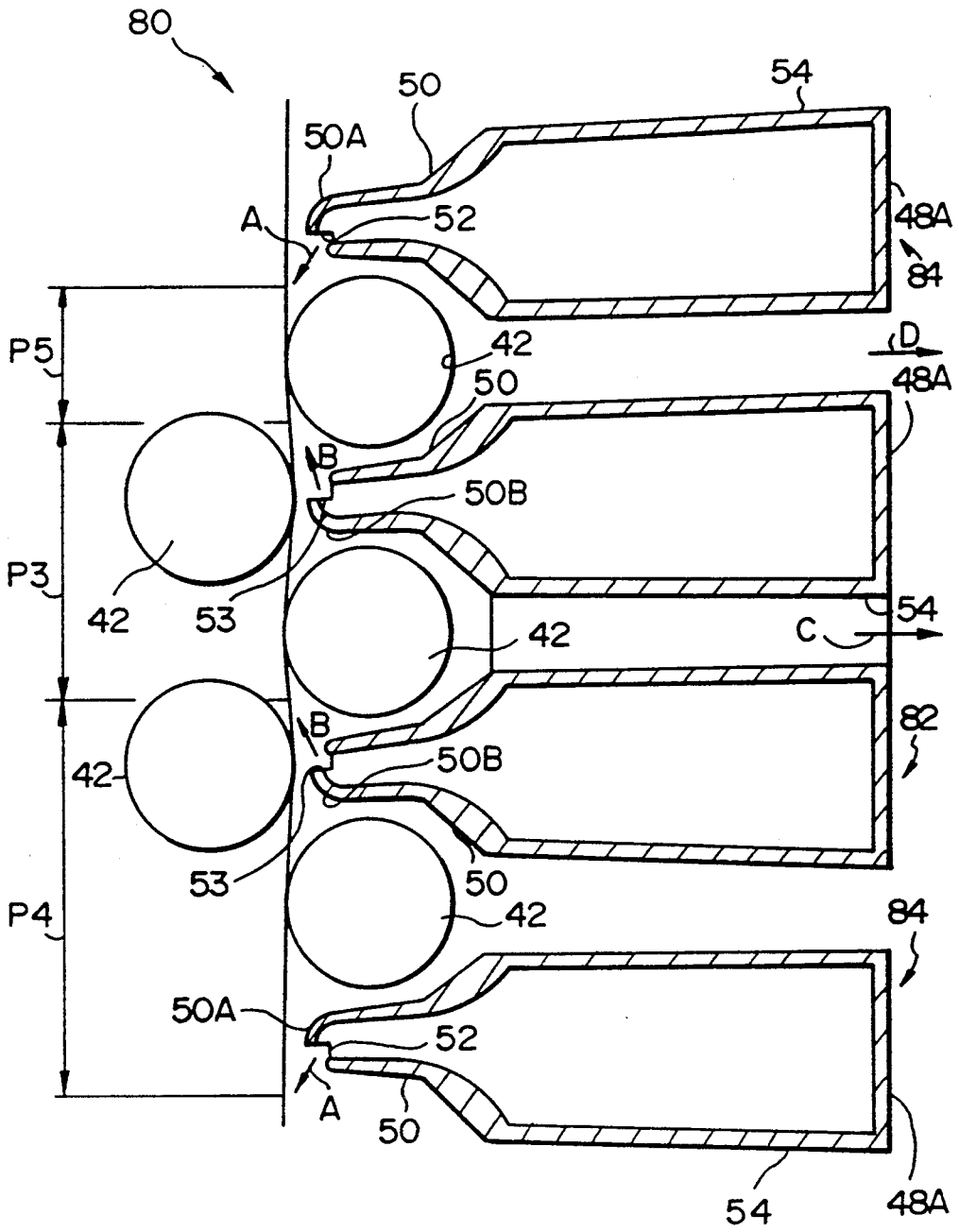
FIG. 6 is a cross-sectional view similar to that of FIG. 1 and illustrates essential portions of the photosensitive material drying apparatus in accordance with a second embodiment of the photosensitive material drying apparatus.

FIG. 6 shows a drying section 80 in accordance with a second embodiment of the present invention. In the drying section 80, warm-air supplying chambers 82, 84 are arranged alternately along the film transport passage. The warm-air discharge port 53 and the arcuate portion 50B are formed in each of the pair of warm-air discharging portions 50 provided in each of the warm-air supplying chambers 82, so as to discharge warm air onto each film portion in proximity to and downstream of the roller-contacting portion of the film 14, respectively. Meanwhile, the warm-air discharge port 52 and the arcuate portion 50A are formed in each of the pair of warm-air discharging portions 50 of the warm-air supplying chamber 84 adjacent the warm-air supplying chamber 82, so as to discharge warm air onto each film portion in proximity to and upstream of the roller-contacting portion of the film 14, respectively.

In a drying section body 80A where the warm-air supplying chambers 82 and 84 are disposed, the warm air discharged through respective one warm-air discharge ports 52 and 53 in the warm-air supplying chambers 82 and 84 can be exhausted through the exhaust holes 54 formed in the warm-air supplying chambers 82 and 84, while the warm air discharged through the other warm-air discharge ports 52 and 53 can be exhausted through the open spaces between the adjacent warm-air supplying chambers 82 and 84. As a result, the highly humid air after the drying of the film 14 can be exhausted more sufficiently than in the conventional arrangement.

In addition, if it is assumed that an interval of blowing through the warm-air discharge ports 52 of the warm-air supplying chamber 84 or through the warm-air discharge ports 53 of the warm-air supplying chamber 82 (the interval for the discharge ports 52 being not shown in FIG. 6) is a dimension P3, that an interval of blowing through the warm-air discharge port 53 and the warm-air discharge port 52 located downstream of that warm-air discharge port 53 is a dimension P4, and that an interval of blowing through the warm-air discharge port 52 and the warm-air discharge port 53 located downstream of that discharge port 52 is a dimension P5, then the dimensions P3, P4, and P5 are respectively different. As a result, between the rollers, the warm air is blow onto different portions of the film being transported by the rollers 42, so that even if variations in speed occur in the traveling speed of the film 14, it is possible to eliminate unevenness in the drying of the film 14.

It should be noted that although in the above-described first and second embodiments the warm air is guided by the offset warm-air discharge ports 52 and 53 and arcuate portions 50A and 50B of the warm-air discharging portions 50, it suffices if the warm air can be blown onto film portions each located in proximity to and upstream of a roller-contacting portion of the film 14 and onto film portions each located in proximity to and downstream of another roller-contacting portion of the film 14. For instance, each warm-air discharging portions may comprise a pair of warm-air discharge ports which are not offset and a pair of rectifying plates for guiding the warm air discharged through the warm-air discharge ports toward a film portion located in proximity to and upstream of the roller-contacting portion of the film 14 and toward a film portion located in proximity to and downstream of the roller-contacting portion of the film 14, respectively.

In addition, although in the above-described first and second embodiments an example has been given of a case where six warm-air supplying chambers 48 and 82 (84) are disposed in the drying section body 34A or 80A, the present invention suffices if the ward air can be blow onto film portions each located in proximity to and upstream of a roller-contacting portion of the film 14 and onto film portions each located in proximity to and downstream of another roller-contacting portion of the film 14. Hence, no restrictions are imposed on the configuration of the warm-air supplying chambers, the number thereof, and the like.

Furthermore, in the above-described first and second embodiments, an example has been described in which the warm air is blow onto portions in proximity to the roller-contacting portions of the film 14, i.e., the warm air is blown at a desired angle with respect to the film 14 along the traveling direction as viewed in the transverse direction of the film 14. However, the direction of the warm air blown may or may not be perpendicular to the film surface with respect to the transverse direction of the film 14.

Referring now to FIGS. 7 to 11, a description will be given of a third embodiment of the present invention. In the description of this embodiment, those members portions, arrangements, and the like that are similar to those of the first embodiment will be denoted by the same reference numerals, and a detailed description thereof will be omitted.

Figure 8:
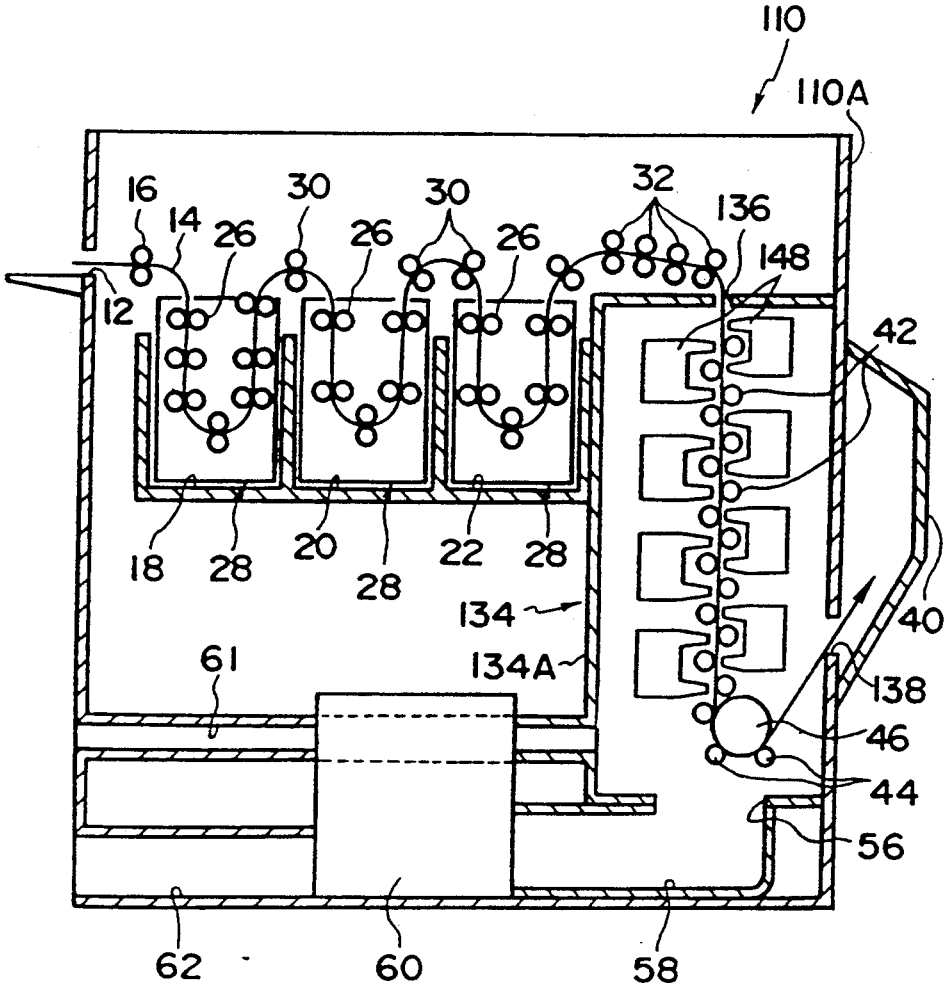
FIG. 8 is a schematic cross-sectional view of the automatic processor to which the photosensitive material drying apparatus in accordance with the third embodiment is applied.

FIG. 8 schematically illustrates the structure of an automatic processor 110. In this automatic processor 110, arrangements other than the photosensitive material drying apparatus are similar to those of the automatic processor 10 of the first embodiment, so that a description will be omitted with respect to the similar arrangements.

As shown in FIG. 8, the film 14 squeezed by the pairs of rollers 32 is carried into a drying section body 134A of a drying section 134 via a transport port 136 in the same way as in the first embodiment. The plurality of rollers 42 supported rotatably by the drying section body 134A are arranged in a zigzag manner inside the drying section body 134A, and a transport passage for the film 14 is formed by these rollers 42. The rollers 42 are disposed at equal intervals along the transport passage. These rollers 42 rotate as a driving force of an unillustrated driving means is imparted thereto, so as to transport the film 14 sent to the interior of the drying section body 134A in a downstream direction (downwardly in FIG. 8) along the transport passage.

Two guide rollers 44 having the same diameter as that of the roller 42 and a guide roller 46 having a larger diameter than that of the roller 42 are disposed in a lower portion of the drying section body 134A. The rollers 44 and 46 are rotatably supported by the drying section body 134A, and the driving force of the unillustrated driving means is transmitted thereto. The film 14 guided to the lower portion of the drying section body 134A is inverted by these rollers 44 and 46, and is discharged through a discharge port 138 to the film-receiving box 40 attached to the outside of a machine body 110A.

Figure 9:
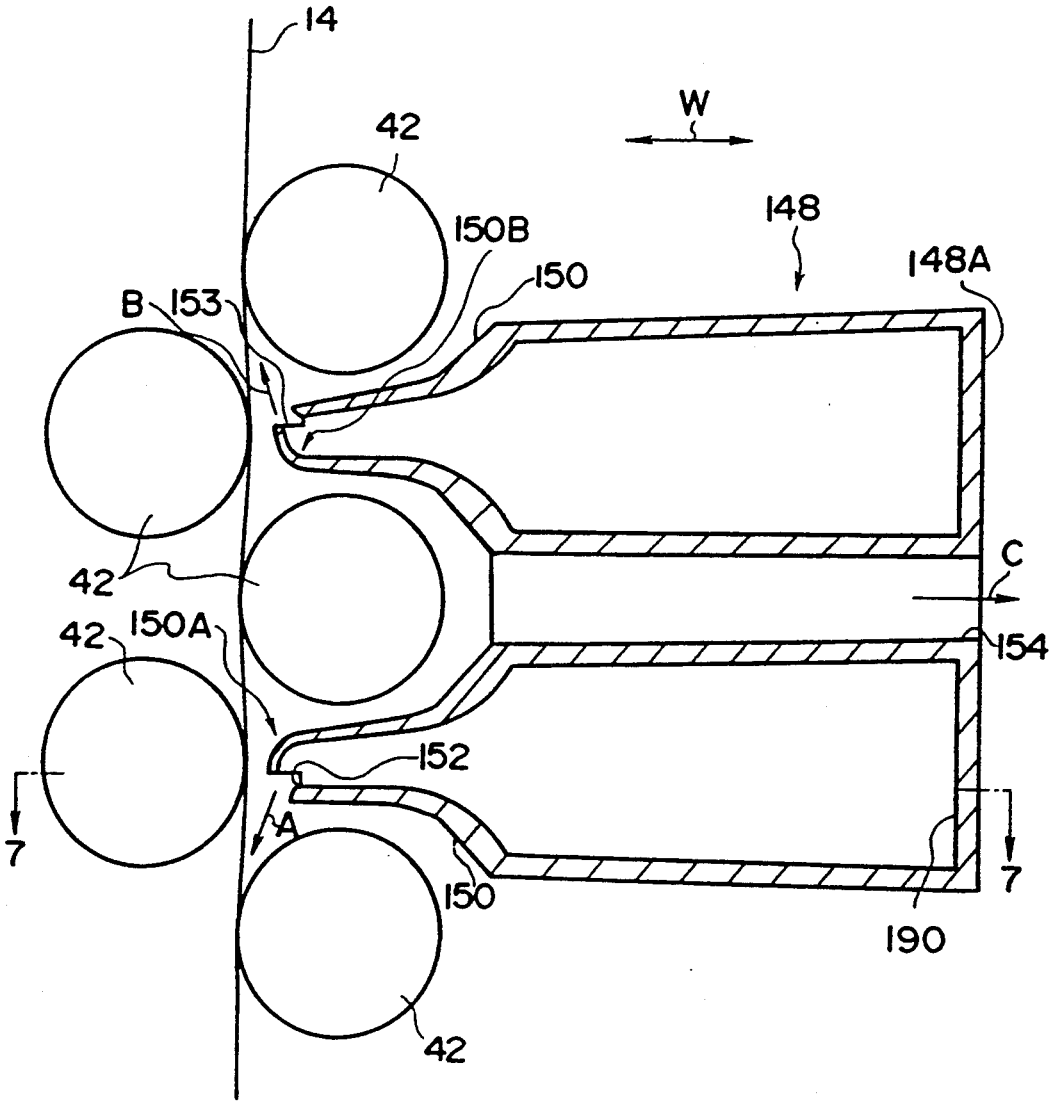
FIG. 9 is a cross-sectional view of essential portions of the photosensitive material drying apparatus in accordance with the third embodiment.
Figure 10:
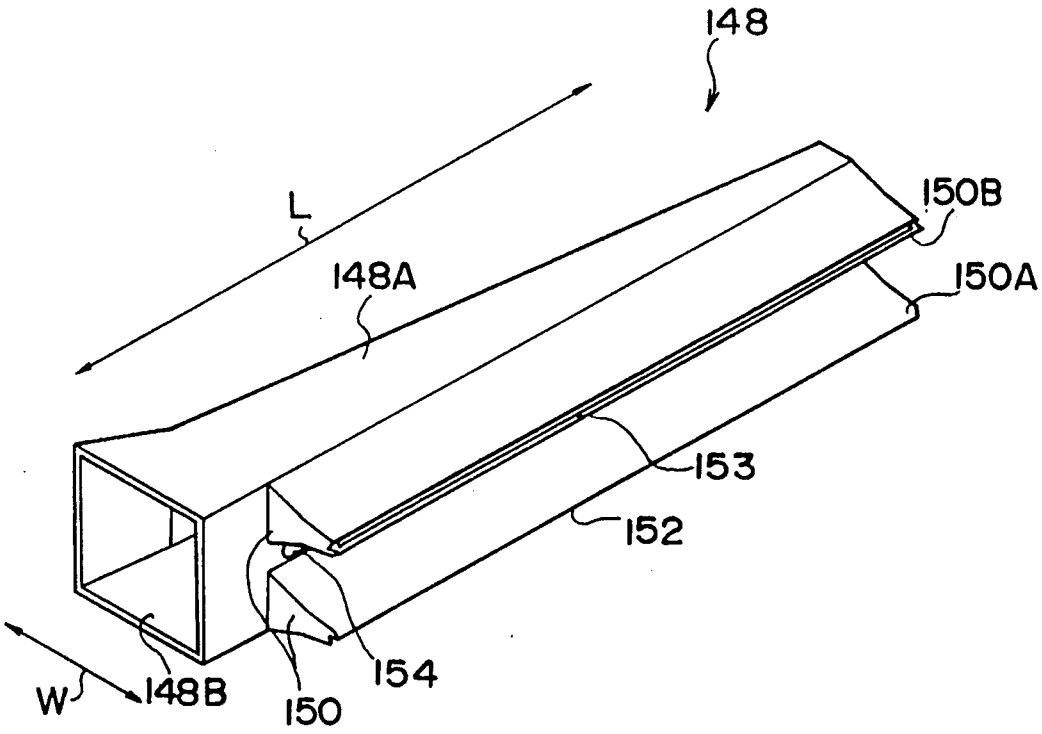
FIG. 10 is a perspective view of a warm-air supplying chamber in accordance with the third embodiment.

Warm-air supplying chambers 148 are disposed in two rows with the film transport passage placed therebetween in the vicinity of the rollers 42 inside the drying section body 134A. As shown in FIGS. 9 and 10, each warm-air supplying chamber 148 comprises a proximal portion 148A, a pair of warm-air discharging portions 150, and a pair of warm-air discharge ports 152 and 153 respectively formed in the pair of warm-air discharging portions 150. As shown in FIG. 10, an opening 148B is formed at a longitudinal end of the proximal portion 148A, and warm air produced by the fan 60 and the heater which will be described later is supplied through the opening 148B. The longitudinal direction (the direction of double-headed arrow L in FIG. 10) of each proximal portion 148A is parallel with the transverse direction of the film 14, and the longitudinal dimension of the proximal portion 148A is set to be greater than the widthwise dimension of the film 14. In addition, the warm-air discharge ports 152 and 153 are arranged in such a manner as to face the film 14 from a position slightly spaced apart from the opening 148B at one end of the proximal portion 148A to the opposite end thereof remote from the opening 148B.

Each of the proximal portions 148A is provided with the pair of warm-air discharge ports 150 extending in the longitudinal direction thereof and projecting toward the film transport passage. Each of these warm-air discharging portions 150 has a hollow interior and communicates with the interior of the proximal portion 148A. As shown in FIG. 9, the warm-air discharge ports 152 and 153 are each provided in such a manner as to be offset toward one thicknesswise (vertical in FIG. 1) end of the warm-air discharging portion 150, and the respective thicknesswise other ends thereof are formed in an arcuate form as arcuate portions 150A and 150B. That is, in the upstream-side warm-air discharging portion 50 as viewed in the advancing direction of the film 14, the warm-air discharge port 153 is formed on the upstream side, while the arcuate portion 150B is formed on the downstream side. In the downstream-side warm-air discharging portion 150, the warm-air discharge port 152 is formed on the downstream side, while the arcuate portion 150A is formed on the upstream side.

In addition, the total area of the openings of the warm-air discharge ports 152 and 153 in the pair of warm-air discharging portions 150 is set to be equal to the total area of the opening 148B in the proximal portion 148A.

An exhaust hole 154 is formed in each proximal portion 148A in such a manner as to extend transversely therethrough between extensions of the pair of warm-air discharging portions 150. The air in the vicinity of the transport passage is exhausted through these exhaust holes 154 in the direction of arrow C in FIG. 9.

Figure 7:
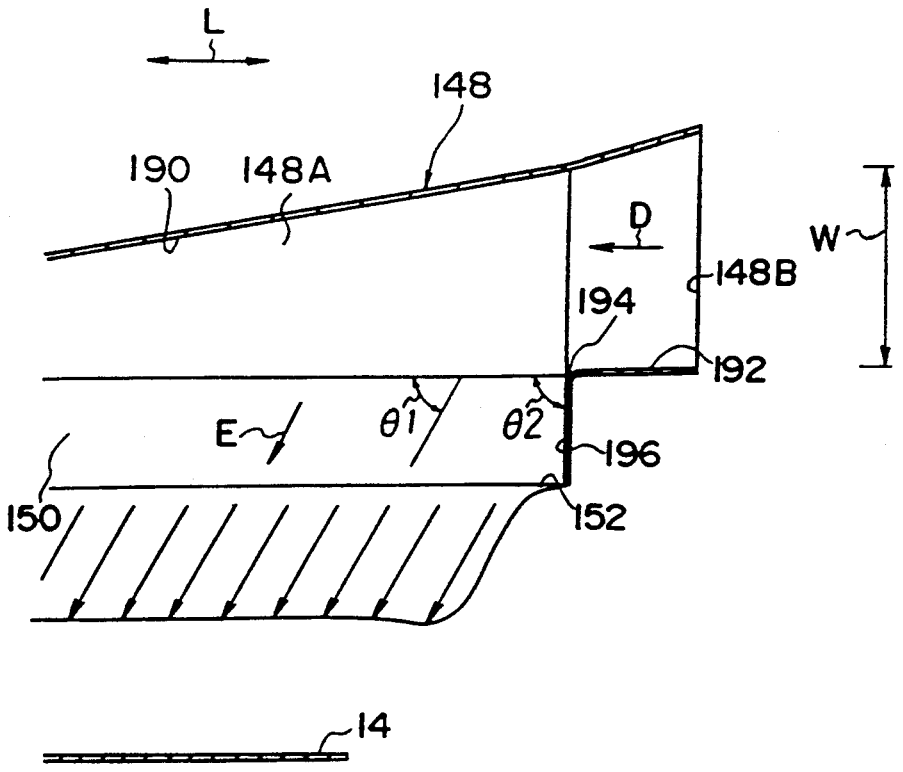
FIG. 7 is a cross-sectional view illustrating essential portions of the photosensitive material drying apparatus in accordance with a third embodiment of the present invention and taken along the line 7—7 of FIG. 9.

Furthermore, as shown in FIG. 7, a rear wall surface 190 constituting a part of the proximal portion 184A is formed in such a manner as to gradually approach the film transport passage from an end of the proximal portion 148A on the opening 148B side to the other end thereof. The proximal portion 148A serves as a portion converting the direction of warm air received through the opening 148B, and the amount of warm air discharged through the warm-air discharge ports 152 and 153 is made substantially uniform as viewed in the traveling direction of the film 14. The direction of the warm air sent through the opening 148B in the direction of arrow D in FIG. 7 is converted to the direction of arrow E in FIG. 7 by the wall surface 190. The angle of conversion of the direction of warm air with respect to the transverse direction of the film 14 as viewed in the traveling direction of the film 14 is set to be an angle $\theta 1$. It should be noted that the multiplicity of arrows directed toward the film 14, shown in FIG. 7, indicate the direction of warm air discharged, and the length of the arrow indicates the amount of warm air discharge per unit time.

In addition, a wall surface 192 adjacent to the opening 148B of the proximal portion 148A and located on the film transport passage side is joined to a wall surface 196 of the warm-air discharging portion 150 on the opening 148B side via an angle portion 194 serving as a warm-air adjusting means. The angle of this wall surface 196 of the warm-air discharging portion 150 with respect to the transverse direction of the film 14 is set to be $\theta 2$. This angle $\theta 2$ is set to be substantially orthogonal, and is set to be greater than the angle $\theta 1$ at which the warm air is discharged. By means of these wall surfaces 192, 196 and the angle portion 194, the amount of warm air discharged through the warm-air discharge ports 152 and 153 is rendered substantially uniform along the transverse direction of the film 14.

Figure 11:
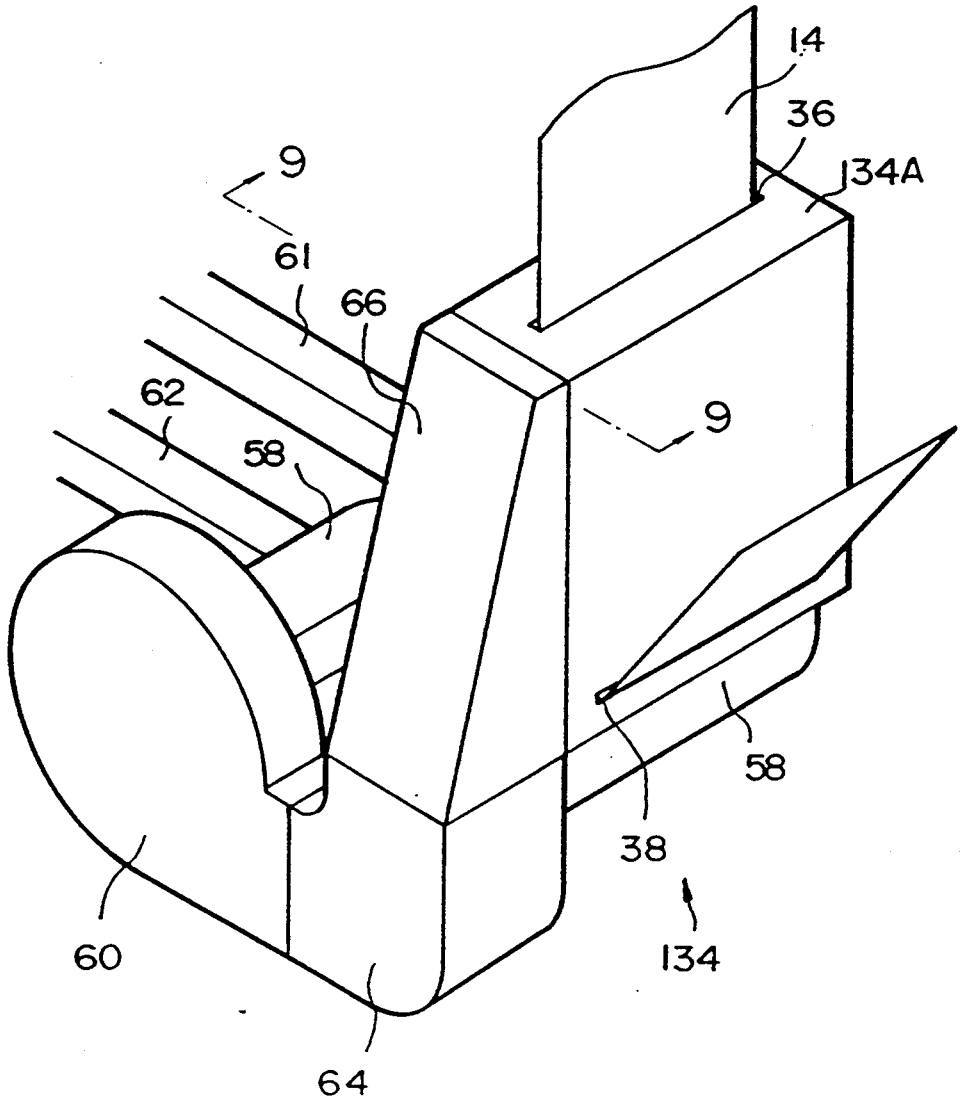
FIG. 11 is a perspective view of the body of a drying section in accordance with the third embodiment.

FIG. 11 shows the appearance of the drying section 134, but since it is similar to the drying section 34 of the first embodiment, a description thereof will be omitted.

It should be noted that in this embodiment the rate of warm air produced by the fan 60 and the heater box 64 and sent to the duct 66 is set to be 10.8 $m^3$/min. This warm air is supplied uniformly to the warm-air supplying chambers 148, and the rate of warm air supplied to each warm-air supplying chamber 148 is set to be 1.35 $m^3$/min.

Since the other arrangements of this embodiment are similar to those of the first embodiment, a description thereof will be omitted.

A description will now be given of the operation of this third embodiment.

With the automatic processor 110 shown in FIG. 8, the film 14 imagewise exposed and inserted through the insertion port 12 is subjected to development, fixing, and washing, is then squeezed by the pairs of rollers 32, and is transported through the transport port 136 to the drying section body 134A of the drying section 134.

Inside the drying section body 134A, the film 14 is transported downwardly by the rollers 42, and the warm air discharged through the warm-air discharge ports 152 and 153 in the warm-air discharging portions 150 is blown onto the film 14 to dry the same.

The highly humid air after the drying of the film 14 passes through the exhaust holes 154 in the warm-air supplying chambers 148 or through the open spaced formed between adjacent ones of the warm-air supplying chambers 184 so as to be exhausted from the film surface in a direction away from the film 14. In addition, the film 14 subjected to drying in the drying section 134 is inverted by the guide rollers 44 and 46, and is then transported through the discharge port 138 to the film-receiving box 40 attached to the outside of the machine body 110A.

As for drying inside the drying section body 134A, the film 14 is transported downwardly by the rollers 42, and the warm air discharged through the warm-air discharge ports 152 and 153 in the warm-air discharging portions 150 is blown onto the film 14 to dry the same. At this juncture, the warm air discharged through the warm-air discharge ports 152 and 153 is discharged in the direction of arrows A and B in FIG. 9 along the film transport passage, as viewed in the transverse direction of the film 14, by means of the offset discharge ports 152 and 153 and the arcuate portions 150A and 150B.

In addition, the warm air discharged through the warm-air discharge ports 152 and 153 along the transverse direction of the film 14 in the direction of arrow E in FIG. 7 is blow substantially uniformly onto the film 14 in the transverse direction thereof as viewed in the traveling direction of the film 14. That is, since part of the warm air passing the vicinity of the wall surface 196 produces a swirl in the vicinity of the wall surface 196 owing to the angle portion 194, the amount of warm air discharged in the vicinity of the wall surface 196 is reduced, so that the amount of warm air discharged from the vicinity of the wall surface 196 becomes substantially equal to the amount discharged from the remaining portions. Hence, the amount of warm air discharged through the warm-air discharge ports 152 and 153 becomes substantially uniform along the transverse direction of the film 14.

Figure 16:
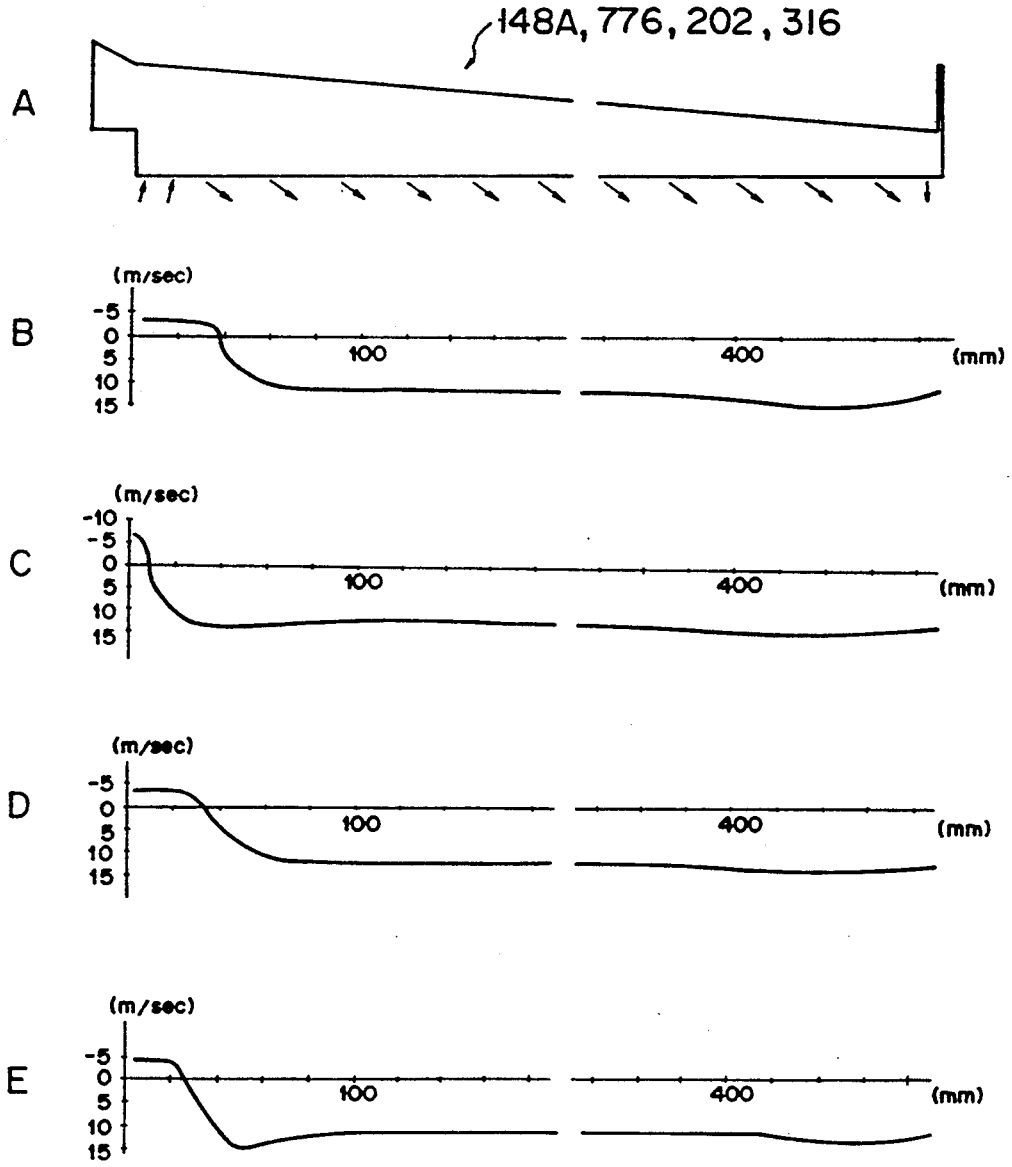
FIG. 16A is a plan view of an essential portion of the drying section in accordance with the third embodiment.
FIGS. 16B–16D are graphs illustrating changes in the velocity of warm air discharged through warm-air discharge ports in accordance with the third to fifth embodiments, respectively.
FIG. 16E is a graph illustrating the case of the prior art.
Figure 17:
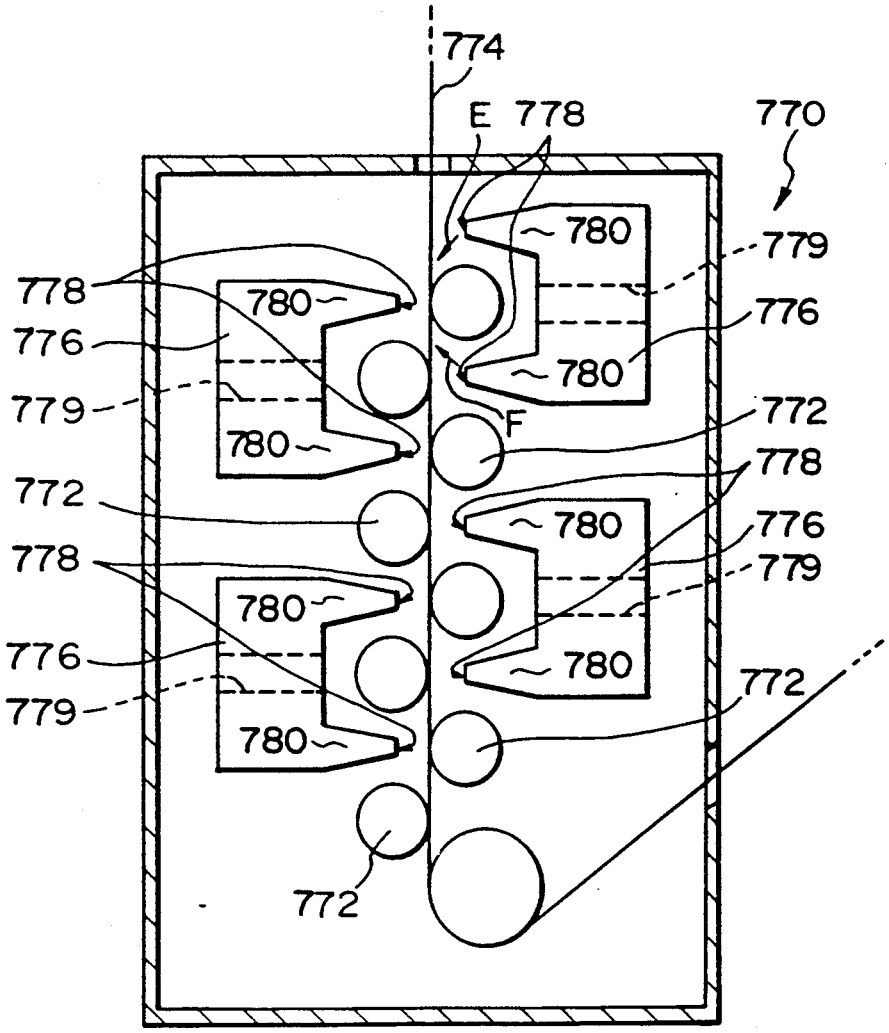
FIG. 17 PRIOR ART
FIG. 17 is a cross-sectional view illustrating a drying section in accordance with the prior art.
Figure 18:
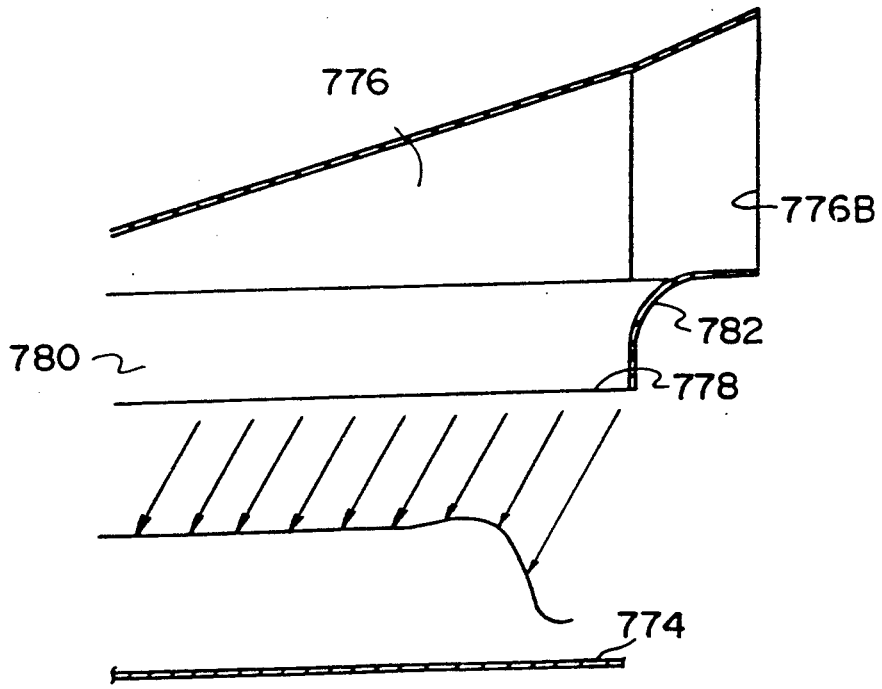
FIG. 18 PRIOR ART
FIG. 18 is a cross-sectional view similar to that of FIG. 7 which shows the third embodiment, and illustrates essential portions in accordance with the prior art.

Meanwhile, the conventional photosensitive material drying apparatus 770 shown in FIG. 17 is structured such that, to reduce the passage resistance of warm air, a curved surface 782 bent gradually in an arcuate configuration from an opening 776B to a warm-air discharging portion 780 is formed, as shown in FIG. 18, to receive the warm air produced by the fan and the heater which are not shown, thereby reducing the passage resistance of the warm air from the warm-air supplying chamber 776 to the warm-air discharging portion 780. It should be noted that the multiplicity of arrows directed from the warm-air discharge port 778 toward the film 74, shown in FIG. 18, indicate the direction of warm air discharged, and the length of the arrow indicates the amount of warm air discharge per unit time. In addition, the velocity of warm air discharged through the warm-air discharge port 778 is shown in the part E of FIG. 16. With the warm-air supplying chamber 776 and the warm-air discharging portion 780 shown in FIG. 18, however, the amount of warm air discharged through the warm-air discharge port 778 in the vicinity of the curved surface 782 is greater than in the remaining portions. In the film 74 which is dried by such air, excessively dried portions can occur in the vicinity of the warm-air discharge port 778 on the curved surface 782 side, and these excessively dried portions sometimes appear in the form of unevenly reflecting portions on the surface of the finished film 74. In order to prevent the warm air from being thus discharged in large volumes onto certain portions of the film 74, it is necessary to increase the size of the warm-air discharge port 778 in the transverse direction of the film 74, which causes the photosensitive material drying apparatus 770 to become large in size, and the drying efficiency with respect to the amount of warm air produced becomes aggravated. That is, with the conventional photosensitive material drying apparatus 770, the curved portion 782 is gradually bent in an arcuate form, and the warm air flows along the curve, so that the warm air is discharged in large volumes in the vicinity of the curved portion 782 as compared to the portions remote from the curved portion 782. In this embodiment, the curve in the angle portion 194 is made extremely small, and the angle 02 at which the wall surface 196 of the warm-air discharging portion 150 is bent with respect to the wall surface 192 of the proximal portion 148A is set to be greater than the angle $\theta 1$ at which the warm air is discharged. Hence, a swirl of warm air is produced in the vicinity of the wall surface 196 by the angle portion 194, thereby making it possible to discharge the warm air substantially uniformly from the vicinity of the wall surface 196 of each of the warm-air discharge ports 152 and 153 to the other end.

Thus, with the photosensitive material drying apparatus in accordance with this embodiment, since the angle portion 194 having a small radius of curvature is formed between the wall surface 192 of the proximal portion 148A and the wall surface 196 of the warm-air discharging portion 150, it is possible to discharge warm air substantially uniformly over a range from the vicinity of the wall surface 196 of each of the warm-air discharge ports 152 and 153 to the other end.

The angle $\theta 1$ which is the direction of the warm air discharged through the warm-air discharge ports 152 and 153 is determined by the length and direction of the wall surface 190 of the proximal portion 148A and the warm-air discharge ports 152 and 153 as well as by the direction of warm air supplied through the opening 148B. In addition, the amount of warm air discharged from the vicinity of the wall surface 196 by the angle portion 194 of the warm-air discharging portion 150 is determined by the size (the radius of curvature) of the angle portion 194 and the angle $\theta 2$ of the wall surface 196 with respect to the transverse direction of the film 14.

That is, although in this embodiment the angle $\theta 2$ between the wall surfaces 192 and 196 is set to be substantially orthogonal, the present invention is not confined to the same, and it suffices if the angle $\theta 2$ between the wall surfaces 192 and 196 is set to be greater than the angle $\theta 1$ indicating the direction of warm air discharged, and an end of the wall surface 196 on the film 14 side is located outside a line connecting together the corner of the angle portion 194 and an end of the film 14 on the wall surface 196 side.

It should be noted that although in this embodiment the warm air discharged through the warm-air discharge ports 152 and 153 is directed toward film portions each located in proximity to and upstream of a roller-contacting portion of the film 14 and toward film portions each located in proximity to and downstream of another roller-contacting portion of the film 14, the arrangement should not be confined to the same. For instance, an arrangement may be alternatively provided such that the warm-air discharge ports 152 and 153 are adapted to constantly blow warm air onto film portions each located in proximity to and upstream or downstream of the respective roller-contacting portion of the film 14.

In addition, although in this embodiment the direction of warm air discharged through the warm-air discharge ports 152 and 153 is set to be the direction of arrow E in FIG. 7, the arrangement should not be confined to the same, and a deflecting plate may be provided in the vicinity of the warm-air discharge ports 152 and 153 for allowing the warm air whose direction has been changed inside the warm-air supplying chamber 148 to be deflected toward the film 14.

A description will now be given of a fourth embodiment of the present invention. In this embodiment, the automatic processor used in the third embodiment is used, and those components that are basically identical with those of the third embodiment are denoted by the same reference numerals, and a description thereof will be omitted.

Figure 12:
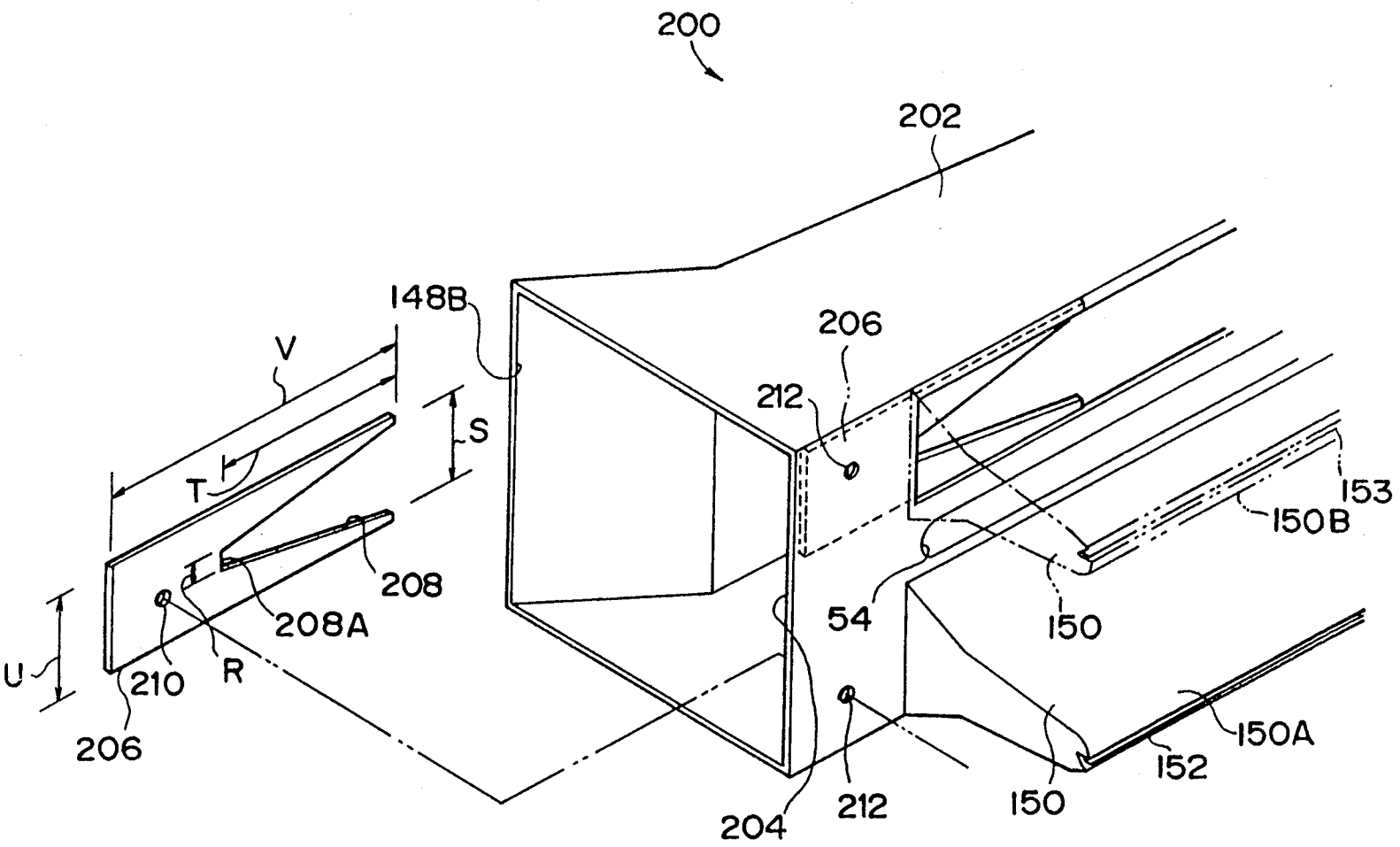
FIG. 12 is a perspective view of essential portions of a drying section in accordance with a fourth embodiment.

FIG. 12 shows a perspective view of essential portions of a warm-air supplying chamber 200 in accordance with the fourth embodiment. The pair of warm-air discharging portions 150 respectively provided with the warm-air discharge ports 152 and 153 are disposed in a proximal portion 202 of the warm-air supplying chamber 200. A baffle plate 206 is provided in the proximal portion 202 in such a manner as to extend in the longitudinal direction of the proximal portion 202 from a wall surface 204 serving as a first wall surface toward the opposite side away from the opening 148B. This baffle plate 206 is formed from a flat rectangular plate elongated in one direction, and a notch 208 having a trapezoidal configuration with a top length R, a bottom length S, and a height T is formed in the baffle plate 206 such that the bottom of the trapezoid is made to conform to a longitudinal end of the baffle plate 206, and a portion of the baffle plate 206 conforming to the top of the trapezoid is formed as an apex portion 208A. In addition, the height U of the baffle plate 206 is set to be equal to or slightly larger than the width of an opening between the proximal portion 202 and the warm-air discharging portion 150 in the traveling direction of the film 14.

A threaded hole 21 is formed in a portion of the baffle plate 206 where the notch 208 is not formed. In addition, a through hole 212 is formed in the wall surface 204 of the proximal portion 202, and an unillustrated screw inserted in this through hole 212 is threadedly engaged with the threaded hole 210 so as to secure the baffle plate 206 to the proximal portion 202. As a result, the apex portion 208A of the baffle plate 206 is located in the vicinity of the angle portion 194.

For example, the present inventor implemented the baffle plate 206 may by cutting a trapezoidal portion with the length R of 3 mm, the bottom length S of 13 mm, and the height T of 30 mm from a plate having a longitudinal length V of 60 mm and a transverse length U of 15 mm.

The part B of FIG. 16 shows changes in the velocity of the warm air discharged through the proximal portion 202 in accordance with the fourth embodiment along the longitudinal direction of the warm-air discharge ports 152 and 153. In the part B of FIG. 16, the abscissa shows the distance from an end portion on the wall surface 196 side, while the ordinate shows the velocity of warm air discharged. As for the ordinate, negative values are shown in the upper portion, while positive values are shown in the lower portion.

As shown in the part B of FIG. 16, although negative values are shown in the vicinity of the wall surface 204, i.e., warm air is sucked into the proximal portion 202 through the warm-air discharge ports 152 and 153, warm air is discharged at a substantially uniform velocity in the remaining portions. In this proximal portion 202, part of the warm air passing the vicinity of the wall surface 196 is shielded by the baffle plate 206, and a swirl is produced near the baffle plate 206 on the warm-air discharge port 152 or 153 side. The velocity of the warm air discharged from the vicinity of the wall surface 196 is decreased by this swirl, and although in the case of the conventional drying apparatus a portion in which the velocity of warm air discharged is increased occurs in the vicinity of the wall surface 196 as shown in the part E of FIG. 16, the velocity of warm air discharged through the warm-air discharge ports 152 and 153 in accordance with the fourth embodiment is rendered substantially uniform over the range from the vicinity of the wall surface 196 to the other end.

It should be noted that although in the fourth embodiment the trapezoidal notch 208 is formed in the baffle plate 206, the arrangement should not be confined to the same, and it is possible to adopt any arrangement insofar as it has a configuration which narrows down the opening of the warm-air discharging portion 150 on the proximal portion 202 side from a longitudinal intermediate portion of the proximal portion 202 toward the wall surface 204. Furthermore, any other arrangement which is capable of causing a swirl in the vicinity of the wall surface 196 can be adopted.

Figure 13:
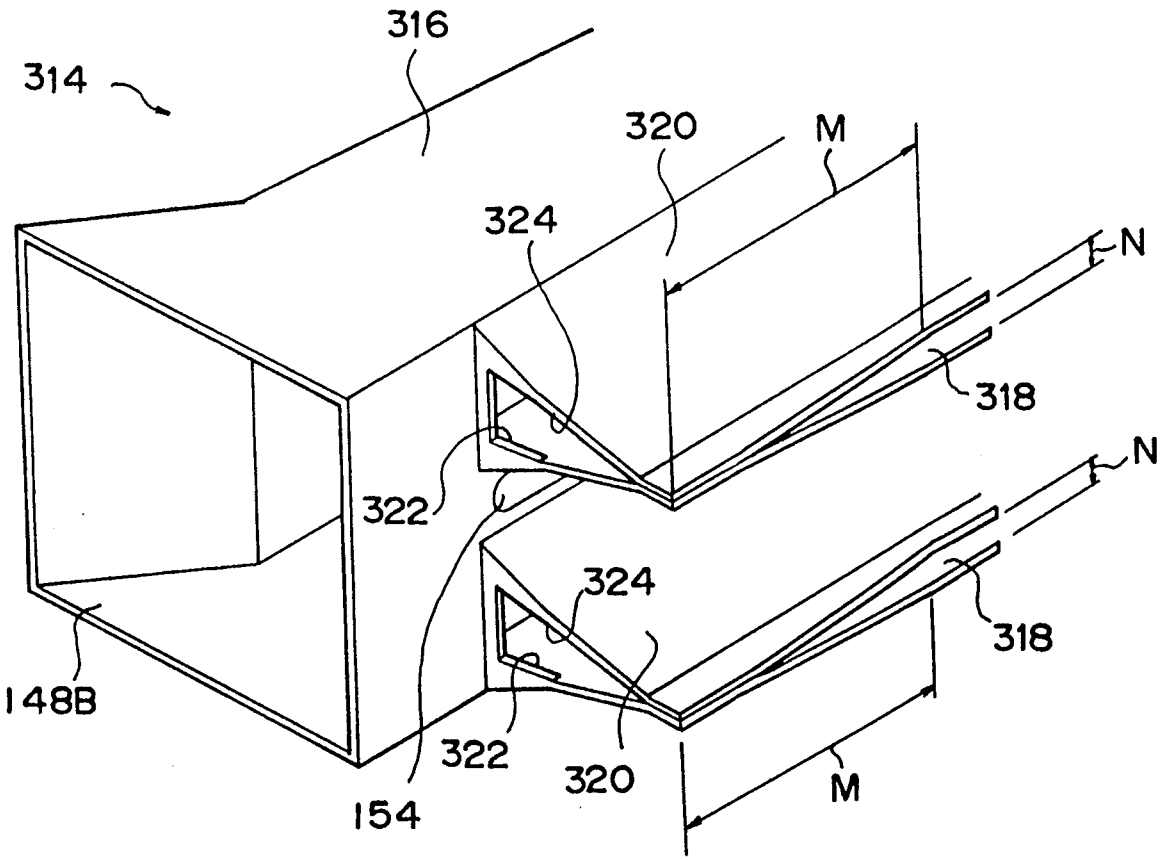
FIG. 13 is a perspective view similar to that of FIG. and illustrating essential portions of a drying section in accordance with a fifth embodiment.

FIG. 13 shows a warm-air supplying chamber 314 in accordance with a fifth embodiment of the present invention.

A pair of warm-air discharging portions 320 each having a pair of side wall surfaces 322 tapered toward a warm-air discharge port 318 are provided on a proximal portion 316 of this warm-air supplying chamber 314. In addition, the gap of the warm-air discharge port 318 is made gradually narrower from a longitudinal intermediate portion of the warm-air discharge port 318 toward an end thereof on one wall surface 322 side over a distance M from one side wall surface 322, and is closed in the vicinity of that side wall surface 322.

This warm-air discharge port 318 is directed perpendicularly to the film transport passage as viewed in the transverse direction of the film 14 and is arranged to blow warm air onto the film surface therethrough. In addition, an opening 324 communicating with the outside of the warm-air discharging portion 320 is formed in one side wall surface 322 of the warm-air discharging portion 320.

For example, the present inventor implemented the warm-air discharging portion 320 by setting the distance M of the warm-air discharge port 318 to 80 mm and the gap N of the warm-air discharge port 318 to 2.5 mm. Results shown in the part C of FIG. 16 were obtained as changes in the velocity of warm air discharged from the warm-air supplying chamber 314 toward the film 14.

Thus, the amount of warm air discharged from the warm-air supplying chamber 314 toward the film surface can be made substantially uniform along the transverse direction of the film 14. In addition, with the warm-air supplying chamber 314, air is sucked through the opening 324 in the side wall surface 322 of the warm-air discharging portion 320 when the warm air is discharged through the warm-air discharge port 318. Because of this, and also due to the fact that the range in which surrounding air is sucked from the warm-air discharge port 318 is narrowed in the vicinity of the side wall surface 322 of the warm-air discharge port 318, the velocity of warm air discharged through the warm-air discharge port 318 can be made substantially uniform up to the vicinity of the side wall surface 322, as shown in the part C of FIG. 16.

Although in the fifth embodiment the warm-air discharging portion 320 is not provided with arcuate portions, an arrangement may be provided such that the arcuate portions 150A and 150B are formed in the same way as in the third and fourth embodiments so as to allow the warm air discharged through the warm-air discharge port 318 to be blown onto the film 14 to the upstream side or downstream side of the transport passage as viewed in the transverse direction of the film 14.

Figure 14:
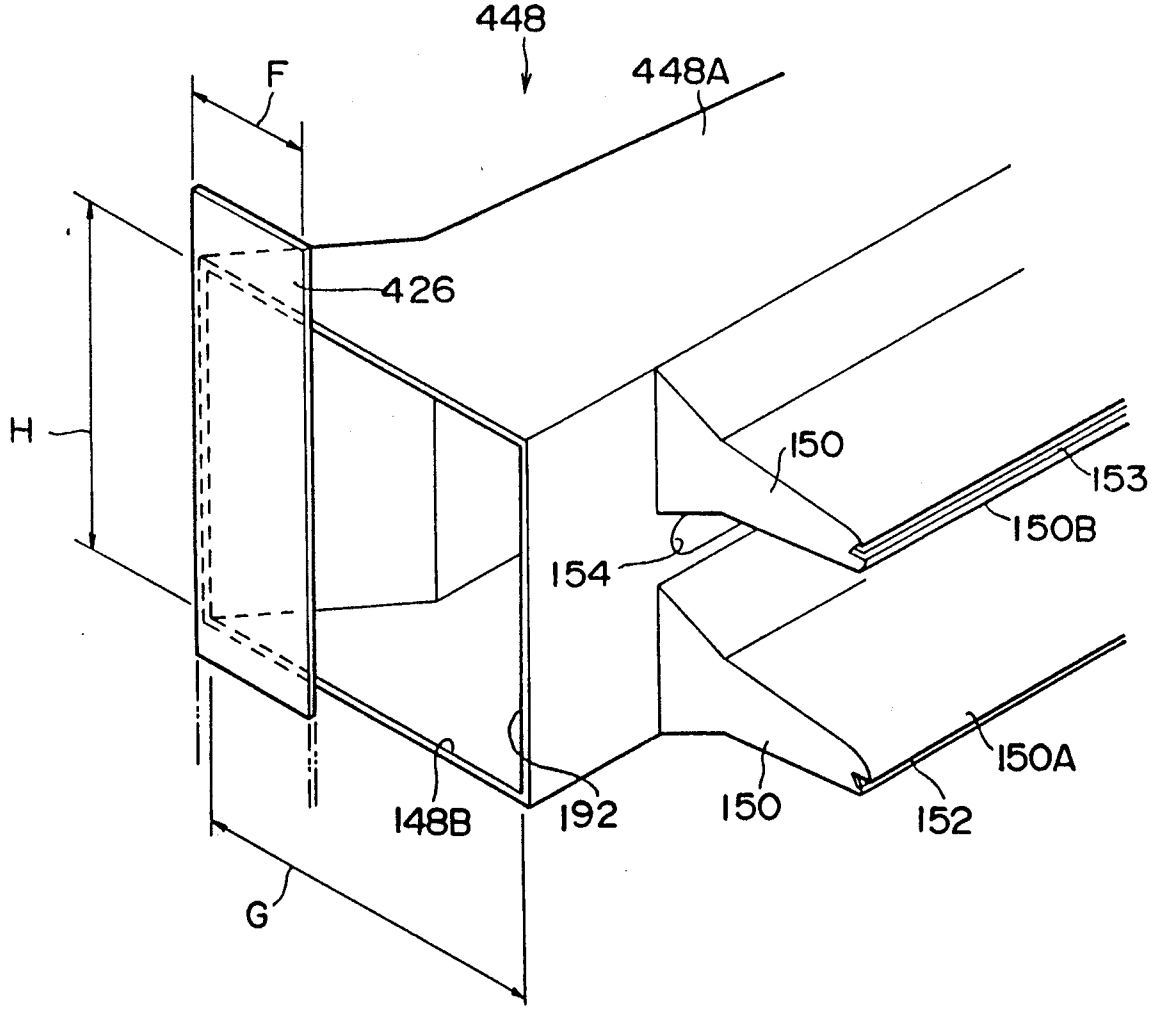
FIG. 14 is a perspective view similar to that of FIG. and illustrating essential portions of a drying section in accordance with a sixth embodiment.

FIG. 14 illustrates a warm-air supplying chamber 448 in accordance with a sixth embodiment of the present invention.

Figure 15:
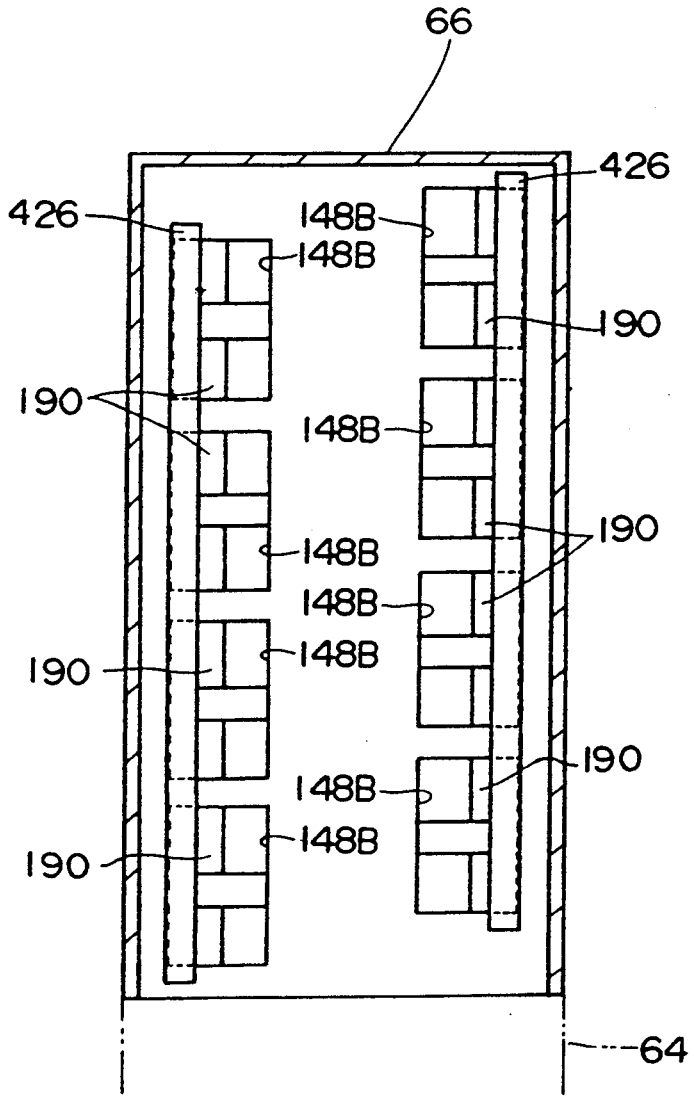
FIG. 15 is a cross-sectional view of essential portions in accordance with the sixth embodiment and taken along the line 15—15 of FIG. 11.

In this warm-air supplying chamber 448, a baffle plate 426 is provided in the opening 148B of a proximal portion 448A. The baffle plate 426 is attached in such a manner as to block part of the opening 148B from the duct 66 side on a side of the proximal portion 448A which is remote from its side where the wall surface 192 is disposed. Furthermore, as shown in FIG. 15, the baffle plate 426 is arranged in such a manner as to continuously block the openings 148B of the plurality of warm-air supplying chambers 448 arranged along the film transport passage.

With reference to FIG. 14, the present inventor provided an arrangement, by way of example, in which the baffle plate 426 with a width F of 17.5 mm was attached to the opening 148B with a height H of 46.5 mm and a width G of 51 mm. As the result of this experiment, the result shown in the part D of FIG. 16 was obtained as the velocity of warm air discharged through the warm-air discharge ports 152 and 153 formed in the proximal portion 448A.

In this sixth embodiment, as for the warm air supplied through the opening 148B via the duct 66, a swirl is produced on the downstream side of the baffle plate 426. As a result, the velocity of warm air passing the vicinity of the baffle plate 426 is lowered as compared to the velocity of warm air passing through a position remote from the baffle plate 426, i.e., a position closer to the film 14. As a result, the direction of air flow is changed, and the amount of warm air discharged through the warm-air discharge ports 152 and 153 in the vicinity of the wall surface 196 is reduced, thereby allowing the warm air to be discharged uniformly along the transverse direction of the film 14.

It should be noted that an opening similar to the opening 324 provided in the wall surface 322 of the warm-air discharging portion 320 in accordance with the fifth embodiment may be provided in the corresponding wall surfaces of the warm-air discharging portions in accordance with the third, fourth, and sixth embodiments. If this arrangement is adopted, it is possible to reduce the amount of air sucked into the proximal portions 148A, 202, and 448A from the warm-air discharge ports 152 and 153 in the vicinity of the aforementioned corresponding wall surfaces, thereby making it possible to extend the range in which the velocity of warm air discharged through the warm-air discharge ports 152 and 153 becomes substantially uniform.

In addition, the rate of warm air produced by the fan 60 and the heater box 64 and sent to the duct 66 was, by way of example, set to 10.8 $m^3$ in the fourth, fifth, and sixth embodiments in the same way as in the third embodiment. This warm air is supplied uniformly to the proximal portion 448A.

Although in the above-described embodiments warm air is used as drying air, the present invention is not confined to warm air, and it is evident that it is possible to use such as drying air obtained by allowing air to pass through a drying agent such as silica gel.

What is claimed is:

1. A photosensitive material drying apparatus for drying a photosensitive material by blowing drying air onto a surface of the photosensitive material moving along a photosensitive material transport passage formed by arranging a plurality of rollers, comprising:

a plurality of drying-air supplying chambers disposed along the photosensitive material transport passage in correspondence with said plurality of rollers;

first and second drying-air discharge ports provided on each drying-air supplying chamber of said plurality of drying-air supplying chambers, said first and second drying-air discharging ports adapted to blow drying air onto a film portion located in proximity to an adjacent roller contacting said photosensitive film, said first and second drying-air discharge ports being offset from each other in such a manner where said first drying air discharge port is oriented in a traveling direction of the photosensitive material and said second drying air discharge port is oriented in a direction opposite to the traveling direction;

a through hole provided on said each drying-air supplying chamber of said plurality of drying-air supplying chambers wherein:

said through hole is defined to extend from a photosensitive material transport passage side of said each drying-air supplying chamber to an opposite side of said each drying-air supplying chamber, an end of said through hole on said photosensitive material transport passage side is disposed between said pair of drying-air discharge ports, and said through hole is used to exhaust drying air which has been blown onto the photosensitive material;

an exhaust passage provided between adjacent drying-air supplying chambers of said plurality of drying-air supplying chamber, and a drying-air exhaust portion attached to a surface of said photosensitive material drying apparatus.

2. A photosensitive material drying apparatus according to claim 1, wherein the drying air is warm air.

3. A photosensitive material drying apparatus according to claim 1, wherein said drying-air discharge ports are formed in a configuration of a slit which is elongated in a direction parallel with a transverse direction of the photosensitive material transport passage, and each of said plurality of drying-air supplying chambers comprises:

an opening portion for receiving drying air from a drying-air producing portion;

a direction-converting portion for converting a direction of drying air received through said opening portion to a direction of said drying-air discharge port; and drying-air adjusting means for rendering drying air discharged through said drying-air discharge port substantially uniform along the transverse direction of the photosensitive material transport passage.

4. A photosensitive material drying apparatus according to claim 3, wherein said drying-air adjusting means comprises:

a first wall surface disposed on the photosensitive material side of said opening portion;

a second wall surface disposed in such a manner as to extend from said first wall surface toward the photosensitive material; and an angle portion joining together said first wall surface and said second wall surface, wherein, an angle between said second wall surface and a traveling direction of the photosensitive material transport passage is greater than an angle between a direction of dry air being discharged from said drying-air discharging ports and the traveling direction of the photosensitive material transport passage.

5. A photosensitive material drying apparatus according to claim 3, wherein said drying-air adjusting means comprises:

a first wall surface disposed on the photosensitive material side of said opening;

a second wall surface disposed with one end abutting said first wall surface and another end oriented toward the photosensitive material; and a baffle plate disposed in such a manner as to project from said first wall surface along said drying-air discharge port.

6. A photosensitive material drying apparatus according to claim 1, wherein said drying-air discharge ports are arranged such that a gap of each drying-air discharge port along a transverse direction of the photosensitive material transport passage is reduced gradually from a longitudinal intermediate portion of said drying-air discharge port toward an end portion of said drying-air discharge port on an opening portion side, such that a portion of said drying-air discharge port on the opening portion side is closed.

7. A photosensitive material drying apparatus according to claim 3, wherein said drying-air adjusting means is constituted by a baffle plate disposed in such a manner as to close part of said opening portion and forming a space wherein the flow of drying air supplied from said drying-air producing portion is prevented.

8. A photosensitive material drying apparatus for drying a photosensitive material by blowing drying air onto a surface of the photosensitive material moving along a photosensitive material transport passage formed by arranging a plurality of rollers, comprising:

a plurality of drying-air supplying chambers disposed along the photosensitive material transport passage in correspondence with said plurality of rollers;

a first pair of substantially parallel drying-air discharge ports provided on every other drying-air supplying chamber of said plurality of drying-air supplying chambers, said first pair of substantially parallel drying-air discharge ports being adapted to blow drying air onto a film portion located in proximity to an adjacent roller contacting said photosensitive film, said first pair of drying-air discharge ports being oriented in a traveling direction of the photosensitive material;

a second pair of substantially parallel drying-air discharge ports provided on each drying-air supplying chamber between said every other drying-air supplying chambers, said second pair of substantially parallel drying-air discharge ports being disposed adjacent to said first pair of drying-air discharge ports and oriented in a direction opposite to the traveling direction of the photosensitive material;

a through hole provided on each drying-air supplying chamber of said plurality of drying-air supplying chamber wherein:

said through hole is defined to extend from a photosensitive material transport passage side of each drying-air supplying chamber to an opposite side of each drying-air supplying chamber, an end of said through hole on the photosensitive material transport passage side is disposed between said pair of drying-air discharge ports, and said through hole is used to exhaust drying air which has been blown onto the photosensitive material; and an exhaust passage provided between adjacent drying-air supplying chambers of said plurality of drying-air supplying chamber and a drying-air exhaust portion attached to a surface of said photosensitive material drying apparatus.

9. A photosensitive material drying apparatus according to claim 8, wherein the drying air is warm air.

10. A photosensitive material drying apparatus according to claim 8, wherein said drying-air discharge ports are formed in a configuration of a slit which is elongated in a direction parallel with a transverse direction of the photosensitive material transport passage, and wherein each of said plurality of drying-air supplying chambers comprises:

an opening portion for receiving drying air from a drying-air producing portion;

a direction-converting portion for converting the direction of drying air received through said opening portion to a direction of said drying-air discharge port; and drying-air adjusting means for rendering drying air discharged through said drying-air discharge port substantially uniform along the transverse direction of the photosensitive material transport passage.

11. A photosensitive material drying apparatus according to claim 10, wherein said drying-air adjusting means comprises:

a first wall surface disposed on the photosensitive material side of said opening portion;

a second wall surface disposed in such a manner as to extend from said first wall surface toward the photosensitive material; and an angle portion joining together said first wall surface and said second wall surface, wherein, an angle between said second wall surface and a direction transverse to a traveling direction of the photosensitive material transport passage is greater than an angle between a direction of dry air being discharge from said drying-air discharging ports and the direction transverse to the traveling direction of the photosensitive material transport passage.

12. A photosensitive material drying apparatus according to claim 10, wherein said drying-air adjusting means comprises:

a first wall surface disposed on the photosensitive material side of said opening;

a second wall surface disposed with one end abutting said first wall surface and another end oriented toward the photosensitive material; and a baffle plate disposed in such a manner as to project from said first wall surface along said drying-air discharge port.

13. A photosensitive material drying apparatus according to claim 10, wherein said drying-air discharge ports are arranged such that a gap of each drying-air discharge port along a transverse direction of the photosensitive material transport passage is reduced gradually from a longitudinal intermediate portion of said drying-air discharge port toward an end portion of said drying-air discharge port on an opening portion side, such that a portion of said drying-air discharge port on the opening portion side is closed.

14. A photosensitive material drying apparatus according to claim 10, wherein said drying-air adjusting means is constituted by a baffle plate disposed in such a manner as to close part of said opening portion and forming a space wherein the flow of drying air supplied from said drying-air producing portion is prevented.

15. A photosensitive material drying apparatus for drying a photosensitive material by blowing drying air onto a surface of the photosensitive material being transported along a photosensitive material transport passage, comprising:

a drying-air supplying chamber having an opening portion into which drying air from a drying-air producing portion flows;

a drying-air discharge port formed in a configuration of a slit which is elongated in a direction parallel with a transverse direction of the photosensitive material transport passage, said drying-air discharge port being adapted to allow drying air flowing into said drying-air supplying chamber to be discharge onto the photosensitive material;

a direction-converting portion for converting a direction of drying air flowing in through said opening portion to a direction of said drying-air discharge port;

drying-air adjusting means for rendering the drying air discharged through said drying-air discharge port substantially uniform along the transverse direction of the photosensitive material transport passage.

16. A photosensitive material drying apparatus according to claim 15, wherein said drying-air adjusting means comprises:

a first wall surface disposed on the photosensitive material side of said opening portion;

a second wall surface disposed in such a manner as to extend from said first wall surface toward the photosensitive material; and an angle portion joining together said first wall surface and said second wall surface, wherein, an angle between said second wall surface and a direction transverse to the traveling direction of the photosensitive material transport passage is greater than an angle between a direction of dry air being discharged from said drying-air discharging ports and the direction transverse to the traveling direction of the photosensitive material transport passage.

17. A photosensitive material drying apparatus according to claim 15, wherein said drying-air adjusting means comprises:

a first wall surface disposed on the photosensitive material side of said opening;

a second wall surface disposed with one end abutting said first wall surface and another end oriented toward the photosensitive material; and a baffle plate disposed in such a manner as to project from said first wall surface along said drying-air discharge port.

18. A photosensitive material drying apparatus according to claim 15, wherein said drying-air discharge port is arranged such that a gap of said drying-air discharge port along the transverse direction of the photosensitive material transport passage is reduced gradually from a longitudinal intermediate portion of said drying-air discharge port toward an end portion of said drying-air discharge port on an opening portion side, such that a portion of said drying-air discharge port on the opening portion side is closed.

19. A photosensitive material drying apparatus according to claim 15, wherein said drying-air adjusting means is constituted by a baffle plate disposed in such a manner as to close part of said opening portion and forming a space wherein the flow of drying air supplied from said drying-air producing portion is prevented.

20. A photosensitive material drying apparatus according to claim 15, wherein the drying air is warm air.

21. The photosensitive material drying apparatus according to claim 1, wherein said plurality of rollers are arranged at equal intervals along said photosensitive material transport passage.

22. The photosensitive material drying apparatus according to claim 8, wherein said plurality of said rollers are arranged at equal intervals along said photosensitive material transport passage.

* * * * *